US010537770B2

(12) United States Patent
Simone et al.

(10) Patent No.: US 10,537,770 B2
(45) Date of Patent: Jan. 21, 2020

(54) GOLF CLUB HEADS WITH STRONGER, MORE FLEXIBLE, AND LIGHTER MATERIALS

(71) Applicant: KARSTEN MANUFACTURING CORPORATION, Phoenix, AZ (US)

(72) Inventors: Matthew W. Simone, Phoenix, AZ (US); Eric J. Morales, Laveen, AZ (US); Cory S. Bacon, Cave Creek, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/387,888

(22) Filed: Dec. 22, 2016

(65) Prior Publication Data

US 2017/0182377 A1 Jun. 29, 2017

Related U.S. Application Data

(60) Provisional application No. 62/271,282, filed on Dec. 27, 2015, provisional application No. 62/328,502, filed on Apr. 27, 2016, provisional application No. 62/399,929, filed on Sep. 26, 2016, provisional application No. 62/428,730, filed on Dec. 1, 2016.

(51) Int. Cl.
*A63B 53/04* (2015.01)

(52) U.S. Cl.
CPC ..... *A63B 53/047* (2013.01); *A63B 53/0466* (2013.01); *A63B 2053/0408* (2013.01); *A63B 2053/0416* (2013.01)

(58) Field of Classification Search
CPC ..... A63B 53/047; A63B 53/0466; A63B 2053/0416; A63B 2053/0408
USPC ..... 473/324–350, 287–292
See application file for complete search history.

(56) References Cited

U.S. PATENT DOCUMENTS 5,390,522 A * 2/1995 Dircks ..... B21D 7/024 72/217
5,407,202 A * 4/1995 Igarashi ..... A63B 53/04 473/342
5,480,153 A * 1/1996 Igarashi ..... A63B 53/04 473/345
6,533,681 B2 3/2003 Inoue et al.
(Continued)

FOREIGN PATENT DOCUMENTS

JP H0889604 4/1996
TW 200948423 12/2009

OTHER PUBLICATIONS

"Researchers Develop Stronger Titanium Alloy" by Engineering360 News Desk, Apr. 7, 2016; retrieved at http://insights.globalspec.com/article/2446/researchers-develop-stronger-titanium-alloy.*
(Continued)

*Primary Examiner* — Sebastiano Passaniti

(57) ABSTRACT

Described herein is a golf club head comprising a faceplate, and a body, at least one of the faceplate and the body comprising a material having a specific strength and/or a specific flexibility greater than the specific strength and specific flexibility of known golf club heads, wherein the specific strength is measured as the ratio of the yield stress to the density of the material, and the specific flexibility is measured as the ratio of the yield stress to the modulus of elasticity of the material.

7 Claims, 8 Drawing Sheets

(56) References Cited

U.S. PATENT DOCUMENTS

| | | | | |
|---|---|---|---|---|
| 7,357,731 | B2 | 4/2008 | Johnson et al. | |
| 7,771,289 | B2 | 8/2010 | Palumbo et al. | |
| 7,857,713 | B2 | 12/2010 | Yokota | |
| 8,012,274 | B2 * | 9/2011 | Skaff | C23C 8/38 148/241 |
| 8,888,607 | B2 | 11/2014 | Harbert et al. | |
| 2004/0099350 | A1 * | 5/2004 | Mantione | C22C 14/00 148/538 |
| 2015/0064055 | A1 | 3/2015 | Kawakami et al. | |
| 2015/0111664 | A1 | 4/2015 | Myrhum | |
| 2015/0273286 | A1 | 10/2015 | Onuki | |

OTHER PUBLICATIONS

"A Highly Rigid Titanium Alloy for Golf Club Faces—SP-700HM", JFE Technical Report No. 11, Jun. 2008.*

Hall A. M. et al., Metallurgy, behavior, and application of 18 percent nickel maraging steels, NASA Technical Report, Jan. 1, 1968; NASA-SP-5051; NASA, Washington, DC, United States.

Ulbrich Stainless Steels & Special Metals, Inc.; Jun. 1, 2015, TI-15-3-3-3-15 Specification Sheet; North Haven CT 06473 United States.

PCT Int'l Search Report and Written Opinion, dated Mar. 3, 2017, for PCT/US2016/068199, filed Dec. 2016.

* cited by examiner

GOLF CLUB HEADS WITH STRONGER, MORE FLEXIBLE, AND LIGHTER MATERIALS

CROSS REFERENCE TO RELATED APPLICATIONS

This claims the benefit of U.S. Provisional Patent Appl. No. 62/271,282, filed on Dec. 27, 2015, U.S. Provisional Patent Appl. No. 62/328,502, filed on Apr. 27, 2016, U.S. Provisional Patent Appl. No. 62/399,929, filed on Sep. 26, 2016, and U.S. Provisional Patent Appl. No. 62/428,730, filed on Dec. 1, 2016, the contents of all of which are incorporated fully herein by reference.

FIELD OF INVENTION

The present disclosure is related to golf clubs. In particular, the present disclosure details stronger, more flexible, and/or lighter materials for golf club heads to improve golf club performance characteristics.

BACKGROUND

Golf club heads take various forms, for example a wood, a hybrid, an iron, a wedge, or a putter. Various types of golf club heads can differ in club head materials to maintain durability and manufacturability, as well as club head shape, design, and dimensions to achieve different performance characteristics.

Currently, various materials are used to manufacture golf club heads. Material selection for golf club heads is based on many factors, including manufacturability and durability. Typically, material yield strength is heavily considered in material selection of golf club heads to ensure the club heads have enough durability to prevent failure. Further, club head designs (e.g. club head shape and dimensions) are used to optimize performance characteristics (e.g. ball speed and club head forgiveness). Currently in the golf industry, materials are not developed or selected to achieve specific performance characteristics. Rather, performance characteristics are achieved through club head design, and materials are selected based on strength and manufacturability for a given design.

There is a need in the art for the ability to analyze, select, and/or develop materials for golf club heads to improve specific performance characteristics (such as ball speed and club head forgiveness) independent of club head design, while maintaining club head durability, such that golf club heads can be developed with performance characteristics optimized to a greater degree than can be accomplished by design alone.

Figure 1:
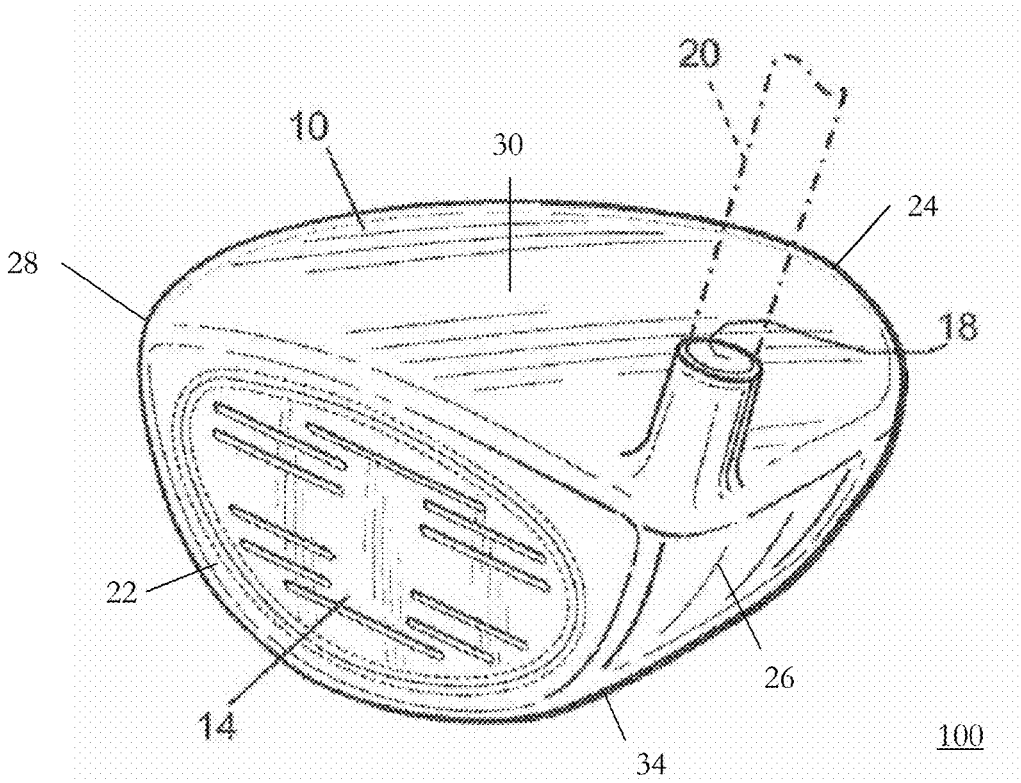
FIG. 1 illustrates a golf club head according to an embodiment.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a golf club head having at least one stronger, more flexible, and/or lighter material (hereafter "material") than materials currently used in golf club heads. The material can be positioned on the faceplate, the body, or a combination of the faceplate and the body. The material includes a strength-to-weight ratio or specific strength measured as the ratio of the yield strength to the density of the material. The stronger, more flexible, and/or lighter material further includes a strength-to-modulus ratio or specific flexibility measured as the ratio of the yield strength to the elastic modulus of the material. Within a material class (e.g. steel, titanium, aluminum, other metals, or composites), the strength to weight ratio and/or strength to modulus ratio of the materials described herein are greater than the strength to weight ratio and/or strength to modulus ratio, respectively, of current golf club head materials.

In many embodiments, the specific strength of the stronger, more flexible, and/or lighter material is greater than the specific strength of current golf club head materials within a similar material class. The increased specific strength of the material can result in a lighter material, and therefore increased discretionary weight of a club head having the material compared to a similar club head with known materials. Increased discretionary weight can allow increased flexibility in weight positioning on the club head, resulting in optimized center of gravity positioning and increased club head moment of inertia (due to increased perimeter weighting). Accordingly, the club head having the material with an increased specific strength can result in an optimized center of gravity position and increased club head forgiveness compared to a similar club head with known materials.

In many embodiments, the specific flexibility of the material is greater than the specific flexibility of current golf club head materials within a similar material class. The increased specific flexibility of the material results in increased flexibility of a club head having the material compared to a similar club head with known materials. Increased flexibility of the club head can decrease the energy loss of a golf ball on impact with a club head, thereby increasing ball speed and distance. Accordingly, the golf club head having the material with the increased specific flexibility can result in increased ball speed and travel distance compared to a similar club head with known materials.

In many embodiments, the stronger, more flexible and lighter material of the golf club head can comprise a specific strength greater than current golf club head materials, combined with a specific flexibility greater than current golf club head materials. In these embodiments, the club head can have increased discretionary weight and flexibility compared to a current golf club head, while maintaining club head durability.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term "composite material," as defined herein, refers to two or more constituent materials with significantly different physical or chemical properties that, when combined, produce materials with characteristics different than the individual components.

The term "material class," as defined herein, refers to a group of materials having similar compositions. For example, titanium alloys, or metals that contain a mixture of titanium and other chemical elements, are referred to herein as a material class. For further example, steel alloys, or materials that contain a mixture of iron and other chemical elements, are referred to herein as a material class.

The terms "strength-to-weight ratio" and "specific strength" as defined herein, refer to a property of a material measured as the ratio of the yield strength of the material to the density of the material.

The terms "strength-to-modulus ratio" and "specific flexibility", as defined herein, refer to a property of a material measured as the ratio of the yield strength of the material to the elastic modulus of the material.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIG. 1 illustrates a golf club head 100 having a body 10 and a faceplate 14. The golf club head 100 further includes a front end 22, a rear end 24 opposite the front end 22, a heel portion 26, a toe portion 28 opposite the heel portion 26, a top or crown 30, and a bottom or sole 34 opposite the crown 30.

The golf club head 100 described herein can be any type of golf club head including a driver-type club head, a fairway wood-type club head, a hybrid-type club head, a crossover-type club head, an iron-type club head, a wedge-type club head, or a putter-type club head. The club head 100 can be coupled to a shaft 20 to form a golf club. In some embodiments, the club head 100 includes a hosel 18 configured to receive the shaft 20 of the golf club. In some embodiments, the club head 100 includes a bore configured to receive the shaft 20 of the golf club.

The golf club head 100 further includes a stronger, more flexible, and/or lighter material (hereafter "material"), or plurality of materials. For example, the golf club head 100 can include a first material. In some embodiments, the entire club head 100 can comprise the first material. In other embodiments, a portion of the club head 100 can comprise the first material. For example, in some embodiments, the faceplate 14 can comprise the first material and the body 10 can comprise a different material or plurality of materials. In other embodiments, the body can comprise the first material and the faceplate can comprise a different material or plurality of materials.

In some embodiments, the golf club head 100 further includes a second material, different than the first material. For example, in some embodiments, the faceplate can comprise the first material and the body can comprise the second material. For further example, in some embodiments, the body can comprise the first material and the faceplate can comprise the second material. In other embodiments, the faceplate can comprise the first and the second material. In other embodiments, the body can comprise the first and the second material.

The stronger, more flexible, and/or lighter material or plurality of materials can comprise any type of material. In some embodiments, the material comprises a titanium alloy. In some embodiments, the material comprises a steel alloy. In some embodiments, the material comprises an aluminum alloy. In some embodiments, the material comprises a composite, such as a carbon fiber composite, a fiberglass composite, a polymer composite, an aramid composite, a boron fiber composite, or natural fiber (e.g. wood) composites. The composite may further comprise polymer resin such as epoxy, vinyl, ester, polyester, polyurethane, or polypropylene. In some embodiments, the composite material can comprise a carbon fiber composite material. In embodiments where the material comprises a carbon fiber composite material, the carbon fiber composite material can be a thermoplastic material. The use of a thermoplastic carbon fiber composite material can reduce processing time required of the material to achieve the desired properties, such as the specific strength and/or specific flexibility compared to the use of a thermoset carbon fiber composite material. In other embodiments, the material can comprise any type of metal, metal alloy, polymer, plastic, or composite material.

In some embodiments, the first material and the second material can comprise the same or similar material compositions. In some embodiments, the first material and the second material can comprise different material compositions.

A. Material Properties

The stronger, more flexible, and/or lighter material includes a specific gravity, a yield stress, an elastic modulus, and an elongation. Referring to Relation 1 below, the elongation of the material can be a percent elongation measured as the ratio of the change in length (ΔL) as a result of a pulling force to the initial length (L) of the material.

$$\text{Percent Elongation} = 100 * \frac{\Delta L}{L} \qquad \text{Relation 1}$$

The material further includes a strength-to-weight ratio or specific strength measured as the ratio of the yield stress ($\sigma_y$) to the density (ρ) of the material (see Relation 2 below), and a strength-to-modulus ratio or specific flexibility measured as the ratio of the yield stress ($\sigma_y$) to the elastic modulus (E) of the material (see Relation 3 below).

$$\text{Specific Strength} = \frac{\sigma_y}{\rho} \qquad \text{Relation 2}$$

$$\text{Specific Flexibility} = \frac{\sigma_y}{E} \qquad \text{Relation 3}$$

Figure 5:
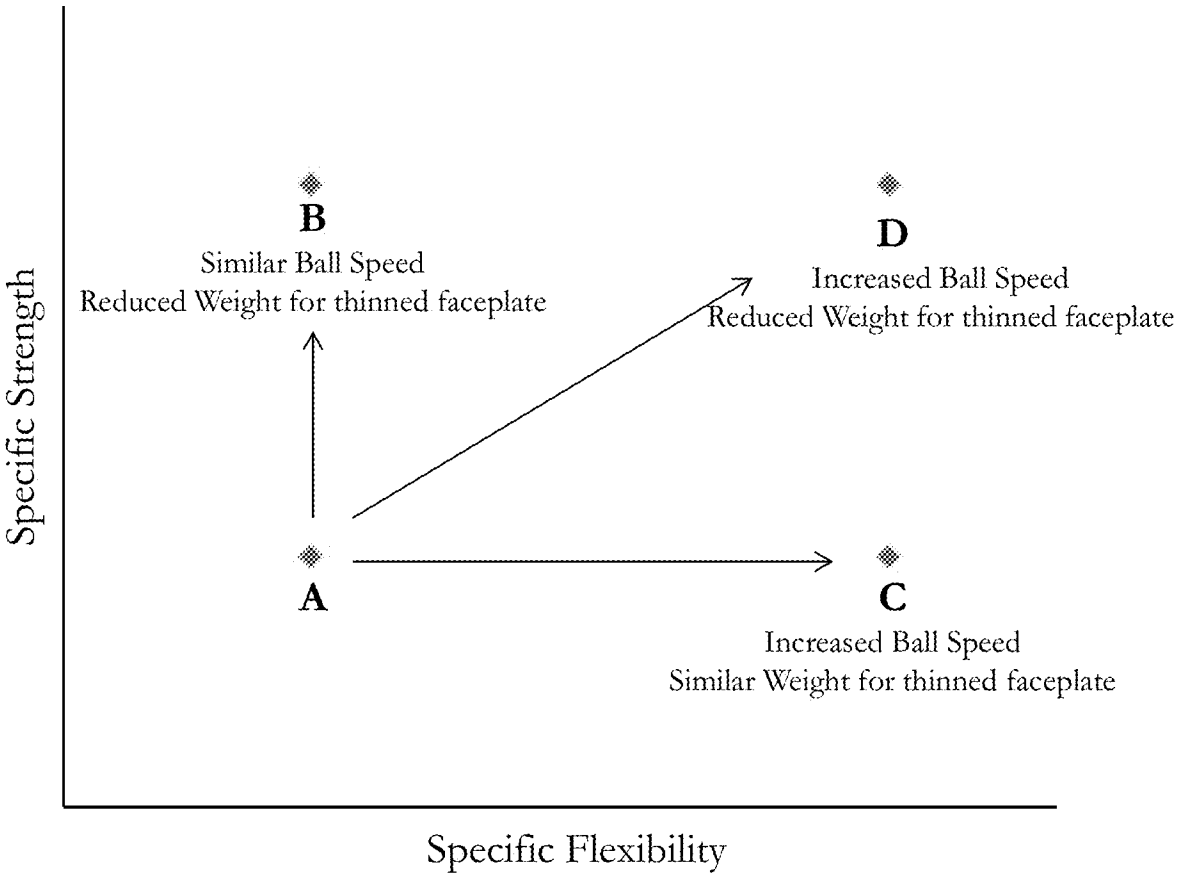
FIG. 5 illustrates performance benefits of various exemplary golf club head materials having increased strength-to-weight and/or strength-to-modulus ratios.

Referring to FIG. 5, increasing the specific strength of a material used in a golf club head (e.g. a club head comprising material B compared to a club head comprising material A) can result in reduced club head weight (increased discretionary weight for optimizing center of gravity position and moment of inertia). Further, increasing the specific flexibility of a material used in a golf club head (e.g. a club head comprising material C compared to a club head comprising material A) can result in increased ball speed and travel distance. Further still, increasing both the specific strength and specific flexibility of a material used in a golf club head (e.g. a club head comprising material D compared to a club head comprising material A) can beneficially result in reduced weight, combined with increased ball speed and travel distance for improved club head performance without sacrificing durability.

Figure 2:
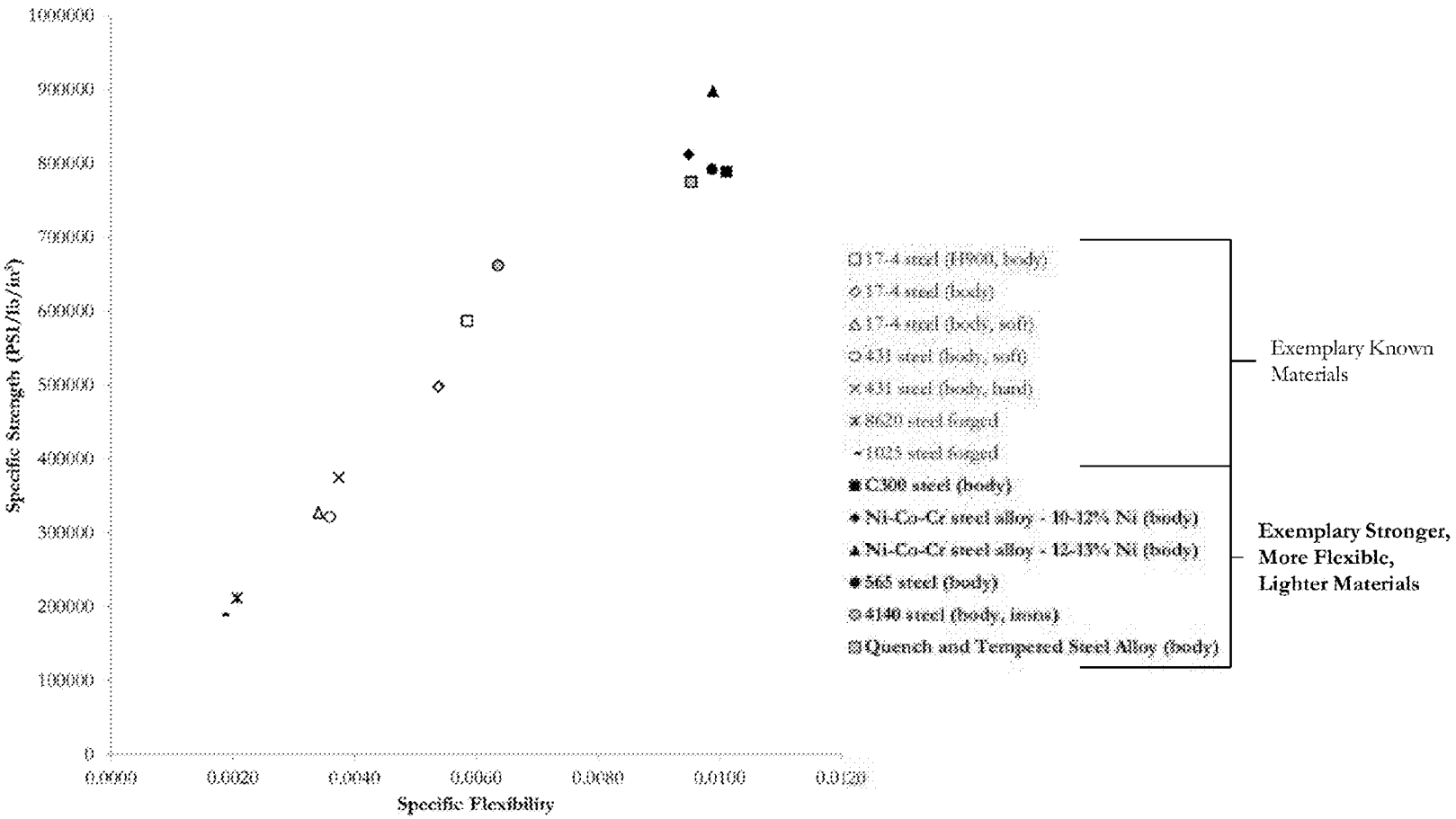
FIG. 2 illustrates the relationship between strength-to-weight ratios and strength-to-modulus ratios of various steel type golf club head materials used in the club head body.
Figure 3:
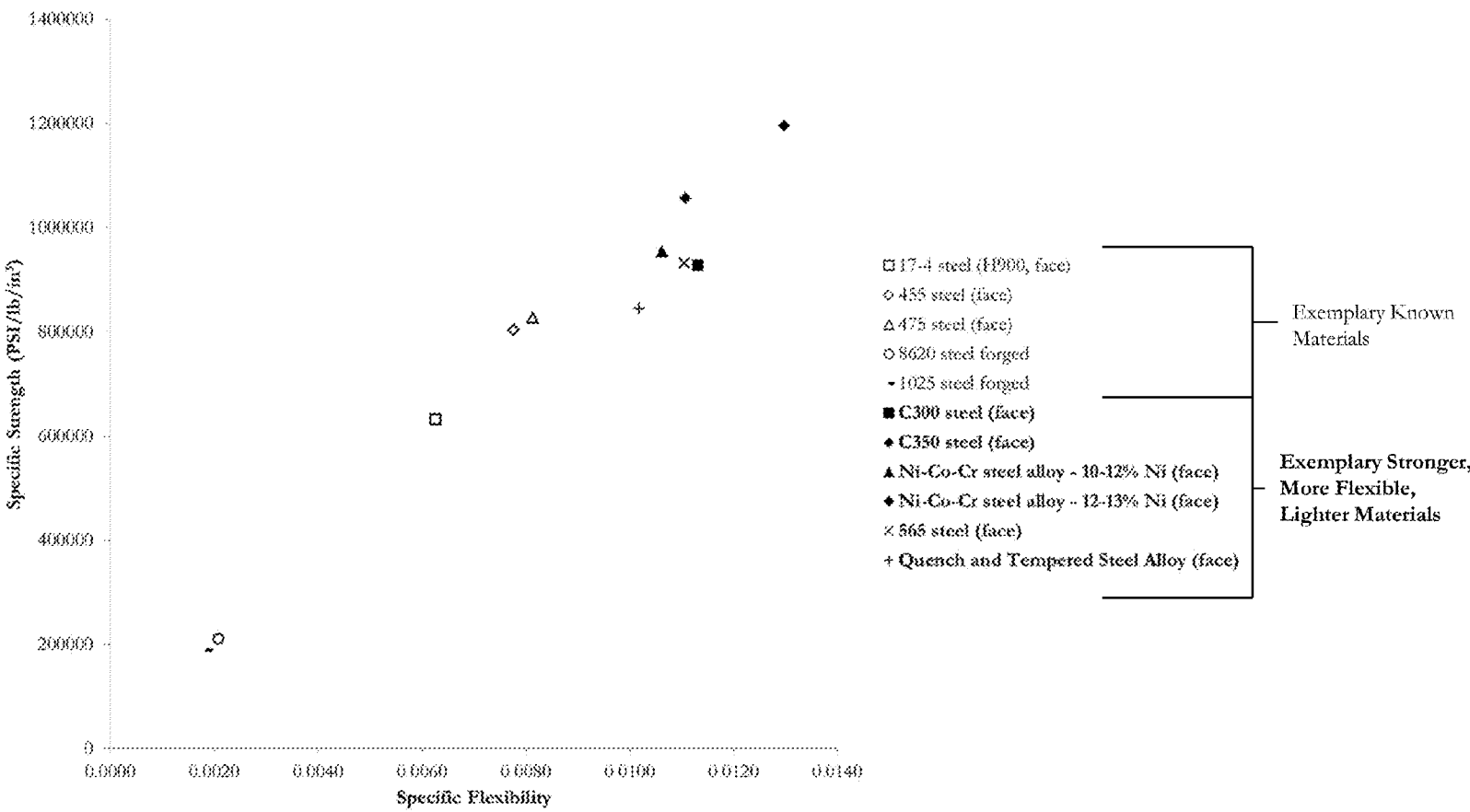
FIG. 3 illustrates the relationship between strength-to-weight ratios and strength-to-modulus ratios of various steel type golf club head materials used in the club head faceplate.
Figure 4:
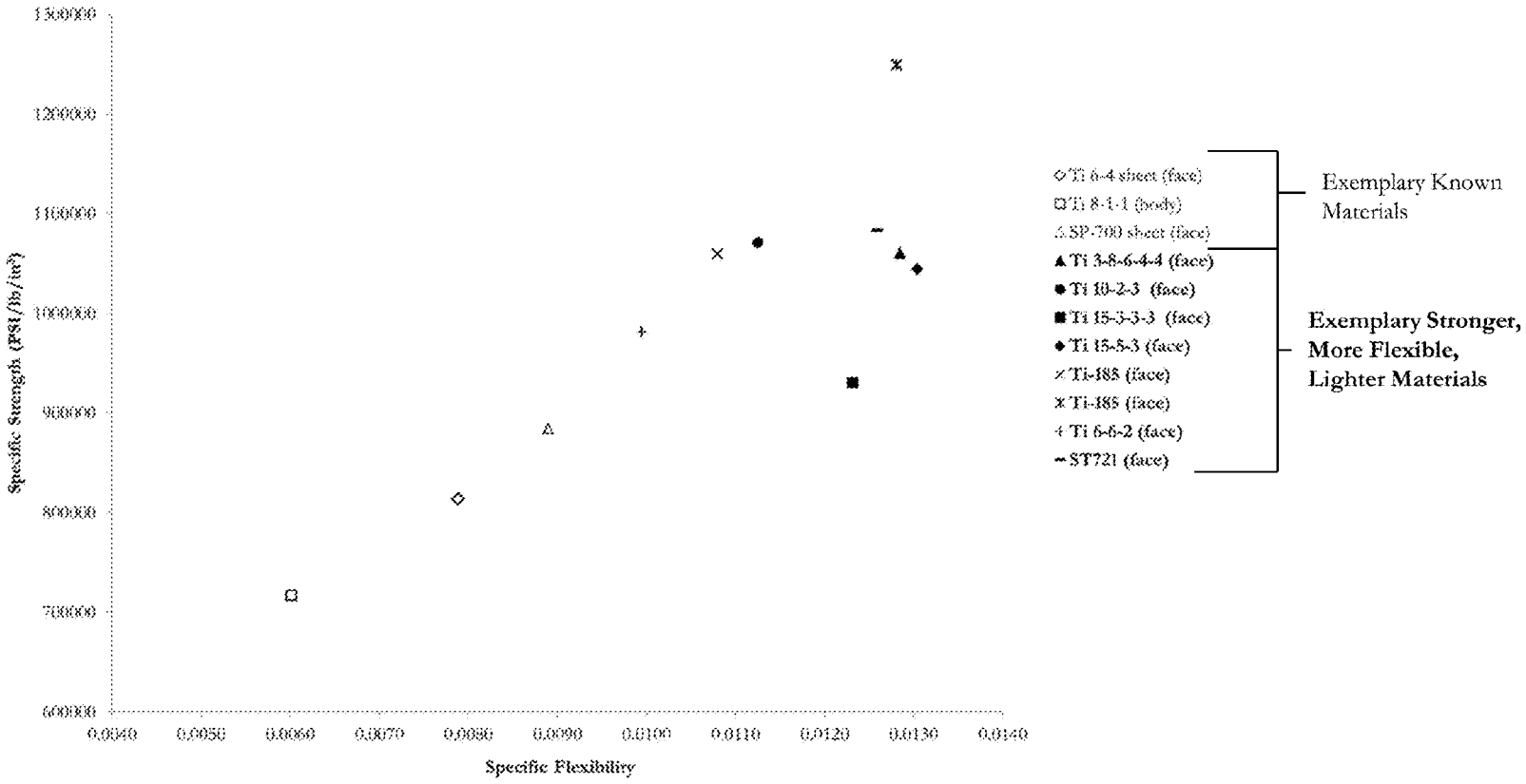
FIG. 4 illustrates the relationship between strength-to-weight ratios and strength-to-modulus ratios of various titanium type golf club head materials.

FIGS. 2-4 illustrate the relationship between the specific strength (strength-to-weight ratio) and the specific flexibility (strength-to-modulus ratio) of various materials currently used in golf club heads (e.g. material A in FIG. 5) compared to the specific strength and specific flexibility of the materials described herein (e.g. material D in FIG. 5). Many current golf club head materials are selected based on yield strength alone. In contrast, selecting materials based on specific strength, in combination with specific flexibility, can provide improvements in club head performance that would not be achievable based on increased yield strength alone. In general, a material having increased specific strength results in a lighter weight material when designed for similar durability, and a material having increased specific flexibility results in increased flexibility when designed for similar durability.

Lightweight materials are desired in golf club heads to increase discretionary weight, and flexible materials are desired in golf club heads to reduce energy loss during impact with a golf ball. However, current club head materials are typically not selected for weight and flexibility (e.g. current club head materials are typically not selected using specific strength in combination with specific flexibility). Rather, current golf club head materials are typically selected according to yield strength or specific strength to prevent failure of the club head based on the club design. Accordingly, current golf club head materials are selected based on strength properties and are further designed to achieve weight reduction, weight redistribution, and flexibility, in addition to other parameters, such as, optimal center of gravity position, and maximized club head moment of inertia.

For example, current golf club heads are typically designed to increase discretionary weight such that more weight can be distributed to specific positions on the club head to achieve a desired center of gravity position and to increase the moment of inertia of the club head. In current club heads, discretionary weight is typically increased by reducing thickness in desired portions of the club head (e.g. faceplate, crown, etc.), while using a material with a yield strength or specific strength to prevent failure of the thinned portions of the club head. For further example, current golf club heads are typically designed to increase bendability or flexibility. In current club heads, flexibility is typically increased by reducing thickness in desired portions of the club head and/or by altering structural design, while using a material with a yield strength or specific strength that can prevent failure of the thinned portions or high stress regions of the club head. In these examples, thinning and/or changing structural design of current club heads is limited by the strength of the material used. Accordingly, weight reduction and flexibility of current club heads achieved by design is limited by material strength. Discretionary weight and/or flexibility can be further increased compared to current club heads by using the stronger, more flexible, and/or lighter materials, as described below, in combination with club head design.

The materials described herein are developed or selected to achieve reduced weight and/or increased flexibility of the club head 100, independent of club head design. To accomplish this, the specific strength and/or the specific flexibility of the materials (e.g. materials B, C, or D of FIG. 5) are greater than the specific strength and/or specific flexibility, respectively, of current golf club head materials (e.g. material A of FIG. 5) within a material class. For example, in some embodiments, the material (e.g. material B of FIG. 5) has an increased specific strength compared to current club head materials (e.g. material A of FIG. 5) within a material class. For further example, in some embodiments, the material (e.g. material C of FIG. 5) has an increased specific flexibility compared to current club head materials (e.g. material A of FIG. 5) within a material class. For further example, in some embodiments, the material (e.g. material D of FIG. 5) has an increased specific strength and an increased specific flexibility compared to current club head materials (e.g. material A of FIG. 5) within a material class. Increased specific strength and specific flexibility compared to current golf club head materials within a given class can result in improved performance characteristics of the golf club head 100 having the stronger, more flexible, and/or lighter material, as described below.

In many embodiments, the specific strength of the material is greater than the specific strength of current golf club head materials within a material class. Increased specific strength can correspond to reduced weight of the material for a given volume, while maintaining durability. The increased specific strength of the material can reduce the weight of the club head 100 independent of club head design, while maintaining a yield strength necessary to prevent failure of the club head 100. In these embodiments, the club head 100 can further be designed (e.g. thickness reduced) to allow additional weight savings while maintaining durability, thereby allowing the club head 100 to have increased discretionary weight compared to a club head with known materials. Increased discretionary weight allows for increased design flexibility in achieving a desired center of gravity position and moment of inertia of the club head 100. For example, increased discretionary weight can allow for positioning of additional discretionary weight low and back on the club head 100 to achieve a low and back center of gravity position. For further example, increased discretionary weight can allow for positioning of additional discretionary weight on the perimeter of the club head 100, thereby increasing the moment of inertia of the club head 100, resulting in increased forgiveness for off center hits. Accordingly, the club head 100 having the material with an increased specific strength can result in an optimized center of gravity position and increased club head moment of inertia compared to a golf club head with known materials.

To the contrary, current golf club head materials, or materials having a lower specific strength than the specific strength of the materials described herein, may have a lower yield strength resulting in reduced durability, or a higher density resulting in an undesired increase in weight and reduced discretionary weight to be optimally positioned in other regions of the club head (thereby preventing optimal center of gravity positioning and preventing moment of inertia gains), compared to a club head having the stronger, more flexible, and/or lighter material described herein.

In many embodiments, the specific flexibility of the material is greater than the specific flexibility of current golf club head materials within a material class. Increased specific flexibility can correspond to increased flexibility of the material for a given shape or configuration. The increased specific flexibility of the material increases the bendability or flexibility (i.e. coefficient of restitution or characteristic time) of the club head 100 independent of club head design, while maintaining a yield strength necessary to prevent failure of the club head 100. In these embodiments, the club head 100 can be further designed (e.g. thickness reduced) to allow additional flexibility while maintaining durability, thereby allowing the club head 100 to have increased flexibility compared to a club head with known materials. Increased flexibility results in increased bending on impact which converts strain energy into kinetic energy (or internal energy or spring energy) for transfer to a golf ball, thereby reducing energy loss on impact and increasing ball speed and travel distance. Accordingly, the club head 100 having the material with an increased specific flexibility can result in increased ball speed and travel distance compared to a similar golf club head with known materials.

To the contrary, current golf club head materials, or materials having a lower specific flexibility than the specific flexibility of the materials described herein, may have a lower yield strength resulting in reduced durability, or a higher elastic modulus resulting in reduced flexibility and/or reduced face deflection, thereby limiting the travel distance of a golf ball compared to a club head having the stronger, more flexible, and/or lighter material described herein.

The club head 100 having the material with an increased specific strength and an increased specific flexibility compared to current golf club head materials of similar material classes can allow increased weight savings and flexibility, independent of club head design, while maintaining enough strength to prevent club head failure. The club head 100 described herein can be further designed for additional weight savings and flexibility without sacrificing club head strength or durability. Accordingly, the club head 100 having the stronger, more flexible, and lighter material can achieve increased discretionary weight (due to increased weight savings) and increased flexibility compared to a similar club head with known materials. Increased discretionary weight of the club head 100 allows more weight to be distributed to specific positions on the club head 100 to achieve a desired center of gravity position and to increase the moment of inertia of the club head 100, resulting in increased club head forgiveness for off center hits. Increased flexibility of the club head 100 allows increased deformation of the club head 100 on impact with a golf ball. Increased deformation of the club head 100 reduces the energy loss on impact such that more energy is transferred to the golf ball to increased ball speed and travel distance.

I). Hollow-Body Club Head with Stronger, More Flexible, Lighter Material

In many embodiments, the club head comprising the stronger, more flexible, and/or lighter material (hereafter "material) can be a hollow body-type club head, such as a driver, a fairway wood, or a hybrid. In many embodiments, the club head can have a loft less than or equal to 35 degrees, less than or equal to 30 degrees, less than or equal to 25 degrees, less than or equal to 20 degrees, less than or equal to 15 degrees, or less than or equal to 10 degrees.

In these embodiments, the club head body 10 can comprise the material, the faceplate 14 can comprise the material, or the club head body 10 and the faceplate 14 can comprise the material.

a). Body Comprising Stronger, More Flexible, Lighter Material

In many embodiments, the body 10 of the club head 100 comprises the stronger, more flexible, and/or lighter material. In these embodiments, the entire body 10 can comprise the material, or at least a portion of the body 10 can comprise the material, with the remainder of the body 10 comprising a different material or plurality of materials. For example, in some embodiments, a portion of the crown 30 of the club head 100 can comprise the material. For further example, in some embodiments, a portion of the sole 34 of the club head 100 can comprise the material. In many embodiments, the material of the body 10 is cast to form at least a portion of the body 10.

In some embodiments, the material comprises greater specific strength and/or greater specific flexibility compared to current materials used in golf club heads after being processed (e.g. heat treated with specific parameters). In other embodiments, the material comprises greater specific strength and/or greater specific flexibility compared to current materials used in golf club heads without heat treatments or other processing techniques. In these embodiments, the material can be processed (e.g. heat treated) to further increase the specific strength and/or specific flexibility compared to current materials used in golf club heads.

i). Body Comprising Stronger, More Flexible, Lighter Steel Alloy

FIG. 2 illustrates the ranges of specific strength (i.e. strength-to-weight ratio) and specific flexibility (i.e. strength-to-modulus ratio) of various steel alloy-type materials used in current club head bodies compared to the stronger, more flexible, and/or lighter materials comprising steel alloys for club head bodies described herein. Many known steel alloy-type materials used in golf club heads bodies have a specific strength less than 600,000 PSI/lb/in$^3$ (149 MPa/g/cm$^3$), a specific flexibility less than 0.0060, a yield strength less than 170,000 PSI (1172 MPa), and an elastic modulus greater than 28,000,000 PSI (193,053 MPa).

In embodiments where the body of the club head 100 includes the stronger, more flexible, and/or lighter material comprising a steel alloy, the specific strength of the steel alloy can be greater than or equal to 600,000 PSI/lb/in$^3$ (149 MPa/g/cm$^3$).

For example, the specific strength of the steel alloy can be greater than or equal to greater than or equal to 625,000 PSI/lb/in$^3$ (156 MPa/g/cm$^3$), greater than or equal to 650,000 PSI/lb/in$^3$ (162 MPa/g/cm$^3$), greater than or equal to 675,000 PSI/lb/in$^3$ (168 MPa/g/cm$^3$), greater than or equal to 700,000 PSI/lb/in$^3$ (174 MPa/g/cm$^3$), greater than or equal to 725,000 PSI/lb/in$^3$ (181 MPa/g/cm$^3$), greater than or equal to 750,000 PSI/lb/in$^3$ (187 MPa/g/cm$^3$), greater than or equal to 775,000 PSI/lb/in$^3$ (193 MPa/g/cm$^3$), greater than or equal to 800,000 PSI/lb/in$^3$ (199 MPa/g/cm$^3$), greater than or equal to 825,000 PSI/lb/in$^3$ (205 MPa/g/cm$^3$), greater than or equal to 850,000 PSI/lb/in$^3$ (212 MPa/g/cm$^3$), greater than or equal to 875,000 PSI/lb/in$^3$ (218 MPa/g/cm$^3$), greater than or equal to 900,000 PSI/lb/in$^3$ (224 MPa/g/cm$^3$), greater than or equal to 925,000 PSI/lb/in$^3$ (230 MPa/g/cm$^3$), greater than or equal to 950,000 PSI/lb/in$^3$ (237 MPa/g/cm$^3$), greater than or equal to 975,000 PSI/lb/in$^3$ (243 MPa/g/cm$^3$), greater than or equal to 1,000,000 PSI/lb/in$^3$ (249 MPa/g/cm$^3$), greater than or equal to 1,025,000 PSI/lb/in$^3$ (255 MPa/g/cm$^3$), greater than or equal to 1,075,000 PSI/lb/in$^3$ (268 MPa/g/cm$^3$), or greater than or equal to 1,125,000 PSI/lb/in$^3$ (280 MPa/g/cm$^3$).

For further example, the specific strength of the steel alloy can be between 600,000 PSI/lb/in$^3$ (149 MPa/g/cm$^3$) and 1,125,000 PSI/lb/in$^3$ (280 MPa/g/cm$^3$), between 625,000 PSI/lb/in$^3$ (156 MPa/g/cm$^3$) and 1,025,000 PSI/lb/in$^3$ (255 MPa/g/cm$^3$), between 725,000 PSI/lb/in$^3$ (181 MPa/g/cm$^3$) and 1,025,000 PSI/lb/in$^3$ (255 MPa/g/cm$^3$), or between 825,000 PSI/lb/in$^3$ (205 MPa/g/cm$^3$) and 1,025,000 PSI/lb/in$^3$ (255 MPa/g/cm$^3$).

In embodiments where the body of the club head 100 includes the stronger, more flexible, and/or lighter material comprising a steel alloy, the specific flexibility of the steel alloy can be greater than or equal to 0.0060. For example, the specific flexibility of the steel alloy can be greater than or equal to 0.0062, greater than or equal to 0.0064, greater than or equal to 0.0066, greater than or equal to 0.0068, greater than or equal to 0.0070, greater than or equal to 0.0072, greater than or equal to 0.0076, greater than or equal to 0.0080, greater than or equal to 0.0084, greater than or equal to 0.0088, greater than or equal to 0.0092, greater than or equal to 0.0096, greater than or equal to 0.0100, greater than or equal to 0.0105, greater than or equal to 0.0110, greater than or equal to 0.0115, greater than or equal to 0.0120, greater than or equal to 0.0125, greater than or equal to 0.0130, greater than or equal to 0.0135, greater than or equal to 0.0140, greater than or equal to 0.0145, or greater than or equal to 0.0150.

For further example, the specific flexibility of the steel alloy can be between 0.0060 and 0.0120, between 0.0070 and 0.0120, between 0.0080 and 0.0120, between 0.0090 and 0.0120, between 0.0060 and 0.0150, between 0.0070 and 0.0150, between 0.0080 and 0.0150, or between 0.0090 and 0.0150.

In embodiments where the body of the club head 100 includes the stronger, more flexible, and/or lighter material comprising a steel alloy, the yield strength of the steel alloy can be greater than or equal to 170,000 PSI (1172 MPa), greater than or equal to 175,000 PSI (1207 MPa), greater than or equal to 180,000 PSI (1241 MPa), greater than or equal to 185,000 PSI (1276 MPa), greater than or equal to 190,000 PSI (1310 MPa), greater than or equal to 195,000 PSI (1344 MPa), greater than or equal to 200,000 PSI (1379 MPa), greater than or equal to 225,000 PSI (1551 MPa), or greater than or equal to 250,000 PSI (1724 MPa). Further, the yield strength of the material comprising the steel alloy can be between 170,000 PSI (1172 MPa) and 250,000 PSI (1724 MPa), between 175,000 PSI (1207 MPa) and 250,000 PSI (1724 MPa), between 180,000 PSI (1241 MPa) and 250,000 PSI (1724 MPa), between 185,000 PSI (1276 MPa) and 250,000 PSI (1724 MPa), between 190,000 PSI (1310 MPa) and 250,000 PSI (1724 MPa), or between 200,000 PSI (1379 MPa) and 250,000 PSI (1724 MPa).

In embodiments where the body of the club head 100 includes the stronger, more flexible, and/or lighter material comprising a steel alloy, the elastic modulus of the steel alloy can be less than or equal to 28,000,000 PSI (193,053 MPa), less than or equal to 27,500,000 PSI (189,606 MPa), less than or equal to 27,000,000 PSI (186,159 MPa), less than or equal to 26,500,000 PSI (182,711 MPa), less than or equal to 26,000,000 PSI (179,264 MPa), less than or equal to 25,500,000 PSI (175,816 MPa), or less than or equal to 25,000,000 PSI (172,369 MPa). Further, the elastic modulus of the steel alloy can be between 25,000,000 PSI (172,369 MPa) and 28,000,000 PSI (193,053 MPa), between 25,000,000 PSI (172,369 MPa) and 27,000,000 PSI (186,159 MPa), or between 25,000,000 PSI (172,369 MPa) and 26,000,000 PSI (179,264 MPa).

In embodiments where the body of the club head 100 includes the stronger, more flexible, and/or lighter material comprising a steel alloy, the density of the steel alloy can be less than or equal to 0.40 lb/in$^3$ (11.0 g/cm$^3$), less than or equal to 0.35 lb/in$^3$ (9.7 g/cm$^3$), less than or equal to 0.30 lb/in$^3$ (8.3 g/cm$^3$), less than or equal to 0.29 lb/in$^3$ (8.0 g/cm$^3$), less than or equal to 0.28 lb/in$^3$ (7.8 g/cm$^3$), less than or equal to 0.27 lb/in$^3$ (7.5 g/cm$^3$), less than or equal to 0.26 lb/in$^3$ (7.2 g/cm$^3$), or less than or equal to 0.25 lb/in$^3$ (6.9 g/cm$^3$). Further, the density of the steel alloy can be between 0.25 lb/in$^3$ (6.9 g/cm$^3$) and 0.40 lb/in$^3$ (11.0 g/cm$^3$), between 0.25 lb/in$^3$ (6.9 g/cm$^3$) and 0.35 lb/in$^3$ (9.7 g/cm$^3$), between 0.25 lb/in$^3$ (6.9 g/cm$^3$) and 0.30 lb/in$^3$ (8.3 g/cm$^3$), between 0.25 lb/in$^3$ (6.9 g/cm$^3$) and 0.29 lb/in$^3$ (8.0 g/cm$^3$), or between 0.25 lb/in$^3$ (6.9 g/cm$^3$) and 0.28 lb/in$^3$ (7.8 g/cm$^3$).

Referring to FIG. 2, the specific strength and/or the specific flexibility of the stronger, more flexible, and/or lighter steel alloy are shifted to a region of the graph outside of the current steel alloy-type materials used in golf club head bodies. For example, the specific strength of the steel alloy can be greater than the specific strength of known steel alloy-type materials used in current golf club head bodies (e.g. material B compared to material A in FIG. 5). Increased specific strength can result in reduced club head weight or increased discretionary weight compared to a similar club head with known steel alloys. For further example, the specific flexibility of the steel alloy can be greater than the specific flexibility of known steel alloy-type materials used in current golf club head bodies (e.g. material C compared to material A in FIG. 5). Increased specific flexibility can result in increased flexibility of the club head body, thereby increasing energy transfer to a golf ball on impact, compared to a similar club head with known steel alloys. In many embodiments, the specific strength and the specific flexibility of the steel alloy can be greater than the specific strength and specific flexibility, respectively, of known steel alloy-type materials (e.g. material D compared to material A in FIG. 5).

In embodiments where the body 10 of the club head 100 comprises the stronger, more flexible, and/or lighter steel alloy, the steel alloy can have any composition capable of achieving the desired specific strength and specific flexibility. For example, the steel alloy can comprise C300 steel having 18.0-19.0 wt % nickel, 8.5-9.5 wt % cobalt, 4.6-5.2 wt % molybdenum, with the remaining alloy composition being iron and other trace elements. In some embodiments, trace elements of the steel alloy comprising C300 steel can include 0.5-0.8 wt % titanium, 0.05-0.15 wt % aluminum, less than 0.5 wt % chromium, less than 0.5 wt % copper, less than 0.1 wt % manganese, less than 0.1 wt % silicon, less than 0.3 wt % carbon, less than 0.01 wt % phosphorus, or less than 0.01 wt % sulfur. In this example, the density of the steel alloy comprising C300 steel is 0.289 lb/in$^3$ (7.99 g/cm$^3$).

As stated above, the steel alloy can be subject to a heat treatment process to achieve the specific strength and the specific flexibility described above. For example, in one embodiment, the steel alloy comprising C300 can be subject to a heat treatment including heating the steel alloy to approximately 830 degrees Celsius for approximately 60 minutes, and subsequently heating the steel alloy to approximately 480 degrees Celsius for approximately 4 hours. In this example, the heat treatment process results in the C300 steel alloy steel having a yield strength of 214,400-241,200 PSI (1478-1663 MPa), an elastic modulus of 22,041,000-22,989,000 PSI (151,970-158,500 MPa), a specific strength of 742,742-835,585 PSI/lb/in$^3$ (185-208 MPa/g/cm$^3$), and a specific flexibility of 0.0097-0.0105. In other embodiments, the heat treatment parameters can vary to achieve the desired specific strength and specific flexibility parameters. For example, the steel alloy comprising C300 can be subject to a heat treatment including heating the steel alloy to 750-900 degrees Celsius for 45-90 minutes, followed by heating the steel alloy to 400-550 degrees for 3-5 hours. Further, in other embodiments, the heat treatment parameters can vary with different steel alloy compositions to achieve the desired specific strength and specific flexibility parameters.

For further example, the steel alloy can comprise C350 steel having 11.0-13.0 wt % cobalt, 18.0-19.0 wt % nickel, 4.5-5.5 wt % molybdenum, 1.0-2.0 wt % titanium, with the remaining alloy composition being iron and other trace elements. In some embodiments, trace elements of the steel alloy comprising C350 steel can include 0.05-0.15 wt % aluminum, less than or equal to 0.03 wt % carbon, less than or equal to 0.01 wt % phosphorus, less than or equal to 0.10 wt % silicon, less than or equal to 0.50 wt % copper, less than or equal to 0.10 wt % manganese, less than or equal to 0.01 wt % sulfur, and less than or equal to 0.50 wt % chromium. In this example, the density of the steel alloy comprising C350 steel is 0.292 lb/in$^3$ (8.08 g/cm$^3$).

Further, the steel alloy can be subject to a heat treatment process to achieve the specific strength and the specific flexibility described above. For example, in one embodiment, the steel alloy comprising C350 can be subject to a heat treatment including heating the steel alloy to approximately 830 degrees Celsius for approximately 60 minutes, and subsequently heating the steel alloy to approximately 512 degrees Celsius for approximately 4 hours. In this example, the heat treatment process results in the C350 steel alloy steel having a yield strength of 279,200-314,100 PSI (1925-2166 MPa), an elastic modulus of 25,017,000-26,093,000 PSI (172,490-179,900 MPa), a specific strength of 956,492-1,076,053 PSI/lb/in$^3$ (238-268 MPa/g/cm$^3$), and a specific flexibility of 0.0112-0.0120. In other embodiments, the heat treatment parameters can vary to achieve the desired specific strength and specific flexibility parameters. For example, the steel alloy comprising C350 can be subject to a heat treatment including heating the steel alloy to 750-900 degrees Celsius for 45-90 minutes, and subsequently heating the steel alloy to 450-550 degrees Celsius for 5-7 hours. Further, in other embodiments, the heat treatment parameters can vary with different steel alloy compositions to achieve the desired specific strength and specific flexibility parameters.

For further example, the stronger, more flexible, and/or lighter steel alloy can comprise a Ni—Co—Cr steel alloy having 2.0-3.0 wt % chromium, 14.0-16.0 wt % cobalt, 10.0-12.0 wt % nickel, 1.0-2.0 wt % molybdenum, with the remaining alloy composition being iron and other trace elements. In some embodiments, trace elements of the Ni—Co—Cr steel alloy can include less than or equal to 0.35 wt % carbon. In this example, the density of the Ni—Co—Cr steel alloy is 0.288 lb/in$^3$ (7.97 g/cm$^3$).

Further, the stronger, more flexible, and/or lighter steel alloy can be subject to a heat treatment process to achieve the specific strength and the specific flexibility described above. For example, the Ni—Co—Cr steel alloy can be subject to a heat treatment including heating the steel alloy to approximately 915 degrees Celsius for approximately 60 minutes, followed by a cryogenic freezing in liquid nitrogen at −73 degrees Celsius for approximately 60 minutes, and subsequently heating the steel alloy to approximately 482 degrees Celsius for approximately 6 hours. In this example, the heat treatment process results in the Ni—Co—Cr steel alloy steel having a yield strength of 220,000-247,500 PSI (1517-1706 MPa), an elastic modulus of 24,087,000-25,123,000 PSI (166,070-173,220 MPa), a specific strength of 763,889-859,375 PSI/lb/in$^3$ (190-214 MPa/g/cm$^3$), and a specific flexibility of 0.0091-0099. In other embodiments, the heat treatment parameters can vary to achieve the desired specific strength and specific flexibility parameters. For example, the Ni—Co—Cr steel alloy can be subject to a heat treatment including heating the steel alloy to 850-950 degrees Celsius for 45-90 minutes, followed by an optional cryogenic freezing in liquid nitrogen at for 45-90 minutes, and subsequently heating the steel alloy to 450-550 degrees Celsius for 4-6 hours. Further, in other embodiments, the heat treatment parameters can vary with different steel alloy compositions to achieve the desired specific strength and specific flexibility parameters.

For further example, the stronger, more flexible, and/or lighter steel alloy can comprise a Ni—Co—Cr steel alloy having 2.0-3.0 wt % chromium, 15.0-16.5 wt % cobalt, 12.0-13.0 wt % nickel, 1.0-2.0 wt % molybdenum, with the remaining alloy composition being iron and other trace elements. In some embodiments, trace elements of the Ni—Co—Cr steel alloy can include less than or equal to 0.4 wt % carbon. In this example, the density of the Ni—Co—Cr steel alloy is 0.284 lb/in$^3$ (7.86 g/cm$^3$).

Further, the steel alloy can be subject to a heat treatment process to achieve the specific strength and the specific flexibility described above. For example, the Ni—Co—Cr steel alloy can be subject to a heat treatment including heating the steel alloy to approximately 968 degrees Celsius for approximately 60 minutes, followed by a cryogenic freezing in liquid nitrogen at −73 degrees Celsius for approximately 60 minutes, heating the steel alloy to approximately 482 degrees Celsius for approximately 2.5 hours, followed by a cryogenic freezing in liquid nitrogen at −73 degrees Celsius for approximately 60 minutes, and heating the steel alloy to approximately 482 degrees Celsius for approximately 2.5 hours, followed by a cryogenic freezing in liquid nitrogen at −73 degrees Celsius for approximately 60 minutes. In this example, the heat treatment process results in the Ni—Co—Cr steel alloy steel having a yield strength of 240,000-270,000 PSI (1655-1862 MPa), an elastic modulus of 25,203,000-26,287,000 PSI (173,770-181,240 MPa), a specific strength of 845,070-950,704 PSI/lb/in$^3$ (210-237 MPa/g/cm$^3$), and a specific flexibility of 0.0095-0.0103. In other embodiments, the heat treatment parameters can vary to achieve the desired specific strength and specific flexibility parameters. For example , the Ni—Co—Cr steel alloy can be subject to a heat treatment including heating the steel alloy to 900-1050 degrees Celsius for 45-60 minutes, followed by an optional cryogenic freezing in liquid nitrogen for 45-90 minutes, heating the steel alloy to 400-550 degrees Celsius for 1.5-3.5 hours, followed by an optional cryogenic freezing in liquid nitrogen for 45-90 minutes, and heating the steel alloy to approximately 400-550 degrees Celsius for 1.5-3.5 hours, followed by an optional cryogenic freezing in liquid nitrogen for approximately 45-90 minutes. Further, in other embodiments, the heat treatment parameters can vary with different steel alloy compositions to achieve the desired specific strength and specific flexibility parameters.

For further example, the stronger, more flexible, and/or lighter steel alloy can comprise 565 steel having 11.0-12.5 wt % chromium, 1.0-2.0 wt % cobalt, 11.0-12.5 wt % nickel, 0.5-1.5 wt % molybdenum, 1.5-2.5 wt % titanium, with the remaining alloy composition being iron and other trace elements. In some embodiments, trace elements of the steel alloy comprising 565 steel can include less than or equal to 0.05 wt % carbon, less than or equal to 0.04 wt % phosphorus, less than or equal to 0.03 wt % sulfur, and less than or equal to 0.5 wt % aluminum. In this example, the density of the steel alloy comprising 565 steel is 0.284 lb/in$^3$ (7.87 g/cm$^3$).

Further, the steel alloy comprising 565 steel can be subject to a heat treatment process to achieve the specific strength and the specific flexibility described above. In this example, the 565 steel alloy scan have a yield strength of 212,000-238,500 PSI (1462-1644 MPa), an elastic modulus of 22,320,000-23,280,000 PSI (153,890-160,510 MPa), a specific strength of 745,439-838,619 PSI/lb/in$^3$ (186-209 MPa/g/cm$^3$), and a specific flexibility of 0.0095-0.0102. In other embodiments, the heat treatment parameters can vary to achieve the desired specific strength and specific flexibility parameters. Further, in other embodiments, the heat treatment parameters can vary with different steel alloy compositions to achieve the desired specific strength and specific flexibility parameters.

For further example, the stronger, more flexible, and/or lighter steel alloy can comprise a quench and tempered steel alloy having 3.0-4.5 wt % nickel, 1.0-2.0 wt % silicon, 0.75-1.5 wt % chromium, less than 1.0 wt % copper, less than 1.25 wt % manganese, less than 1.0 wt % molybdenum, less than 0.75 wt % vanadium, with the remaining alloy composition being iron and other trace elements. In this example, the density of the quench and tempered steel alloy is 0.284 lb/in$^3$ (7.86 g/cm$^3$).

Further, the steel alloy can be subject to a heat treatment process to achieve the specific strength and the specific flexibility described above. In this example, the quench and tempered steel alloy scan have a yield strength of 220,000 PSI (1517 MPa), an elastic modulus of 23,100,000 PSI (159,270 MPa), a specific strength of 774,755 PSI/lb/in$^3$ (193 MPa/g/cm$^3$), and a specific flexibility of 0.0095. In other embodiments, the heat treatment parameters can vary to achieve the desired specific strength and specific flexibility parameters. Further, in other embodiments, the heat treatment parameters can vary with different steel alloy compositions to achieve the desired specific strength and specific flexibility parameters.

ii). Body Comprising Stronger, More Flexible, Lighter Titanium Alloy

FIG. 4 illustrates the ranges of specific strength (i.e. strength-to-weight ratio) and specific flexibility (i.e. strength-to-modulus ratio) of various titanium alloy-type materials used in current golf club heads compared to the stronger, more flexible, and/or lighter materials comprising titanium alloys described herein. Many known titanium alloy-type materials used in golf club heads bodies have a specific strength less than 730,500 PSI/(lb/in$^3$), a specific flexibility less than 0.0065, a yield strength less than 115,000 PSI (793 MPa), and an elastic modulus greater than 18,500,000 PSI (127,553 MPa).

In embodiments where the body of the club head 100 includes the stronger, more flexible, and/or lighter titanium alloy, the specific strength of the titanium alloy can be greater than or equal to 730,500 PSI/lb/in$^3$ (182 MPa/g/cm$^3$). For example, the specific strength of the titanium alloy can be greater than or equal to 650,000 PSI/lb/in$^3$ (162 MPa/g/cm$^3$), greater than or equal to 700,000 PSI/lb/in$^3$ (174 MPa/g/cm$^3$), greater than or equal to 750,000 PSI/lb/in$^3$ (187 MPa/g/cm$^3$), greater than or equal to 800,000 PSI/lb/in$^3$ (199 MPa/g/cm$^3$), greater than or equal to 850,000 PSI/lb/in$^3$ (212 MPa/g/cm$^3$), greater than or equal to 900,000 PSI/lb/in$^3$ (224 MPa/g/cm$^3$), greater than or equal to 950,000 PSI/lb/in$^3$ (237 MPa/g/cm$^3$), greater than or equal to 1,000,000 PSI/lb/in$^3$ (249 MPa/g/cm$^3$), greater than or equal to 1,050,000 PSI/lb/in$^3$ (262 MPa/g/cm$^3$), or greater than or equal to 1,100,000 PSI/lb/in$^3$ (272 MPa/g/cm$^3$). For further example, the specific strength of the titanium alloy can be between 730,500 PSI/lb/in$^3$ (182 MPa/g/cm$^3$) and 1,100,000 PSI/lb/in$^3$ (272 MPa/g/cm$^3$), between 850,000 PSI/lb/in$^3$ (212 MPa/g/cm$^3$) and 1,100,000 PSI/lb/in$^3$ (272 MPa/g/cm$^3$), between 900,000 PSI/lb/in$^3$ (224 MPa/g/cm$^3$) and 1,100,000 PSI/lb/in$^3$ (272 MPa/g/cm$^3$), or between 950,000 PSI/lb/in$^3$ (237 MPa/g/cm$^3$) and 1,100,000 PSI/lb/in$^3$ (272 MPa/g/cm$^3$).

In embodiments where the body 10 of the club head 100 includes the stronger, more flexible, and/or lighter titanium alloy, the specific flexibility of the titanium alloy can be greater than or equal to 0.0060. For example, the specific flexibility of the titanium alloy can be greater than or equal to 0.0065, greater than or equal to 0.0070, greater than or equal to 0.0075, greater than or equal to 0.0080, greater than or equal to 0.0085, greater than or equal to 0.0090, greater than or equal to 0.0095, greater than or equal to 0.0100, greater than or equal to 0.0105, greater than or equal to 0.0110, greater than or equal to 0.0115, or greater than or equal to 0.0120. Further, the specific flexibility of the titanium alloy can be between 0.0070 and 0.0120, between 0.0075 and 0.0120, between 0.0080 and 0.0120, between 0.0085 and 0.0120, between 0.090 and 0.0120, between 0.0095 and 0.0120, or between 0.0100 and 0.0120.

In embodiments where the body of the club head 100 includes the stronger, more flexible, and/or lighter material comprising a titanium alloy, the yield strength of the titanium alloy can be greater than or equal to 115,000 PSI (793 MPa), greater than or equal to 120,000 PSI (827 MPa), greater than or equal to 125,000 PSI (862 MPa), greater than or equal to 130,000 PSI (896 MPa), greater than or equal to 135,000 PSI (931 MPa), greater than or equal to 140,000 PSI (965 MPa), greater than or equal to 145,000 PSI (1000 MPa), greater than or equal to 150,000 PSI (1034 MPa), greater than or equal to 160,000 PSI (1103 MPa), greater than or equal to 170,000 PSI (1172 MPa), greater than or equal to 180,000 PSI (1241 MPa), greater than or equal to 190,000 PSI (1310 MPa), or greater than or equal to 200,000 PSI (1379 MPa). Further, the yield strength of the titanium alloy can be between 120,000 PSI (827 MPa) and 200,000 PSI (1379 MPa), between 130,000 PSI (896 MPa) and 200,000 PSI (1379 MPa), between 140,000 PSI (965 MPa) and 200,000 PSI (1379 MPa), between 150,000 PSI (1034 MPa) and 200,000 PSI (1379 MPa), between 160,000 PSI (1103 MPa) and 200,000 PSI (1379 MPa), or between 170,000 PSI (1172 MPa) and 200,000 PSI (1379 MPa).

In embodiments where the body of the club head 100 includes the stronger, more flexible, and/or lighter titanium alloy, the elastic modulus of the titanium alloy can be less than or equal to 18,500,000 PSI (127,553 MPa), less than or equal to 18,000,000 PSI (124,106 MPa), less than or equal to 17,500,000 PSI (120,658 MPa), less than or equal to 17,000,000 PSI (117,211 MPa), less than or equal to 16,500,000 PSI (113,764 MPa), less than or equal to 16,000,000 PSI (110,316 MPa), less than or equal to 15,500,000 PSI (106,869 MPa), less than or equal to 15,000,000 PSI (103,421 MPa), less than or equal to 14,500,000 PSI (99,974 MPa), or less than or equal to 14,000,000 PSI (96,527 MPa). Further, the elastic modulus of the titanium alloy can be between 14,000,000 PSI (96,527 MPa) and 18,500,000 PSI (127,553 MPa), between 14,000,000 PSI (96,527 MPa) and 17,500,000 PSI (120,658 MPa), between 14,000,000 PSI (96,527 MPa) and 16,500,000 PSI (113,764 MPa), between 14,000,000 PSI (96,527 MPa) and 16,000,000 PSI (110,316 MPa), between 14,000,000 PSI (96,527 MPa) and 15,500,000 PSI (106,869 MPa), or between 14,000,000 PSI (96,527 MPa) and 15,000,000 PSI (103,421 MPa).

In embodiments where the body of the club head 100 includes the stronger, more flexible, and/or lighter titanium alloy, the density of the titanium alloy can be less than or equal to 0.30 lb/in$^3$ (8.3 g/cm$^3$), less than or equal to 0.25 lb/in$^3$ (6.9 g/cm$^3$), less than or equal to 0.20 lb/in$^3$ (5.5 g/cm$^3$), less than or equal to 0.19 lb/in$^3$ (5.3 g/cm$^3$), less than or equal to 0.18 lb/in$^3$ (5.0 g/cm$^3$), or less than or equal to 0.17 lb/in$^3$ (4.7 g/cm$^3$). Further, the density of the titanium alloy can be between 0.17 lb/in$^3$ (4.7 g/cm$^3$) and 0.30 lb/in$^3$ (8.3 g/cm$^3$), between 0.17 lb/in$^3$ (4.7 g/cm$^3$) and 0.25 lb/in$^3$ (6.9 g/cm$^3$), between 0.17 lb/in$^3$ (4.7 g/cm$^3$) and 0.20 lb/in$^3$ (5.5 g/cm$^3$), or between 0.17 lb/in$^3$ (4.7 g/cm$^3$) and 0.19 lb/in$^3$ (5.3 g/cm$^3$).

Referring to FIG. 4, the specific strength and/or the specific flexibility of the stronger, more flexible, and/or lighter titanium alloy are shifted to a region of the graph outside of the current or known titanium alloy-type materials used in golf club head bodies. For example, the specific strength of the titanium alloy can be greater than the specific strength of known titanium alloy-type materials used in current golf club head bodies (e.g. material B compared to material A in FIG. 5). Increased specific strength can result in reduced club head weight or increased discretionary weight compared to a similar club head with known titanium alloys. For further example, the specific flexibility of the titanium alloy can be greater than the specific flexibility of known titanium alloys used in current golf club head bodies (e.g. material C compared to material A in FIG. 5). Increased specific flexibility can result in increased flexibility of the club head body, thereby increasing energy transfer to a golf ball on impact, compared to a similar club head with known titanium alloys. In many embodiments, the specific strength and the specific flexibility of the titanium alloy can be greater than the specific strength and specific flexibility, respectively, of known titanium alloy-type materials (e.g. material D compared to material A in FIG. 5).

In embodiments where the body 10 of the club head 100 comprises the stronger, more flexible, and/or lighter titanium alloy, the titanium alloy can have any composition capable of achieving the desired specific strength and specific flexibility.

iii). Body Comprising Stronger, More Flexible, Lighter Aluminum Alloy

In embodiments where the body of the club head 100 includes the stronger, more flexible, and/or lighter material comprising an aluminum alloy, the specific strength of the aluminum alloy can be greater than or equal to 600,000 PSI/lb/in$^3$ (149 MPa/g/cm$^3$). For example, the specific flexibility of the aluminum alloy can be greater than or equal to 650,000 PSI/lb/in$^3$ (162 MPa/g/cm$^3$), greater than or equal to 700,000 PSI/lb/in$^3$ (174 MPa/g/cm$^3$), greater than or equal to 750,000 PSI/lb/in$^3$ (187 MPa/g/cm$^3$), greater than or equal to 800,000 PSI/lb/in$^3$ (199 MPa/g/cm$^3$), greater than or equal to 850,000 PSI/lb/in$^3$ (212 MPa/g/cm$^3$), greater than or equal to 900,000 PSI/lb/in$^3$ (224 MPa/g/cm$^3$), greater than or equal to 950,000 PSI/lb/in$^3$ (237 MPa/g/cm$^3$), greater than or equal to 1,000,000 PSI/lb/in$^3$ (249 MPa/g/cm$^3$). For further example, the specific strength of the aluminum alloy can be between 600,000 PSI/lb/in$^3$ (149 MPa/g/cm$^3$) and 1,000,000 PSI/lb/in$^3$ (249 MPa/g/cm$^3$), between 700,000 PSI/lb/in$^3$ (174 MPa/g/cm$^3$) and 1,000,000 PSI/lb/in$^3$ (249 MPa/g/cm$^3$), between 800,000 PSI/lb/in$^3$ (199 MPa/g/cm$^3$) and 1,000,000 PSI/lb/in$^3$ (249 MPa/g/cm$^3$), or between 900,000 PSI/lb/in$^3$ (224 MPa/g/cm$^3$) and 1,000,000 PSI/lb/in$^3$ (249 MPa/g/cm$^3$).

In some embodiments, the specific strength of the aluminum alloy can be greater than the specific strength of known aluminum alloy-type materials used in current golf club head bodies. Increased specific strength can result in reduced club head weight or increased discretionary weight compared to a similar club head with known aluminum alloys. In some embodiments, the specific flexibility of the aluminum alloy can be greater than the specific flexibility of known aluminum alloy-type materials used in current golf club head bodies. Increased specific flexibility can result in increased flexibility of the club head body, thereby increasing energy transfer to a golf ball on impact, compared to a similar club head with known aluminum alloys.

In embodiments where the body 10 of the club head 100 comprises the stronger, more flexible, and/or lighter aluminum alloy, the aluminum alloy can have any composition capable of achieving the desired specific strength and specific flexibility. For example, the aluminum can comprise an aluminum 7068 alloy having 7.3-8.3 wt % zinc, 2.2-3.0 wt % magnesium, 1.6-2.4 wt % copper, 0.05-0.15 wt % zirconium, with the remaining alloy composition being aluminum and other trace elements. In some embodiments, trace elements of the aluminum alloy comprising aluminum 7068 alloy can include less than 0.12 wt % silicon, less than 0.15 wt % iron, less than 0.10 wt % manganese, less than 0.05 wt % chromium, or less than 0.10 wt % titanium.

In many embodiments, the stronger, more flexible, and/or lighter aluminum alloy can be positioned on at least a portion of the crown 30, the sole 34, the front end 22, the rear end 24, the heel portion 26, the toe potion 28, or a combination of the above described positions on the body 10 of the club head 100. In some embodiments, the aluminum alloy is positioned on a portion of the crown 30 of the club head 100. In these embodiments, the aluminum alloy extends through an outer surface to an inner surface of the crown 30 defining a thickness. In many embodiments, the thickness can be less than or equal to 1.00 mm, less than or equal to 0.95 mm, less than or equal to 0.90 mm, less than or equal to 0.85 mm, less than or equal to 0.80 mm, less than or equal to 0.75 mm, less than or equal to 0.70 mm, less than or equal to 0.65 mm, less than or equal to 0.60 mm, less than or equal to 0.55 mm, or less than or equal to 0.50 mm.

iv). Body Comprising Stronger, More Flexible, Lighter Composite Material

In embodiments where the body of the club head 100 includes the stronger, more flexible, and/or lighter material comprising a composite material, the specific strength of the composite material can be greater than 2,000,000 PSI/lb/in$^3$ (498 MPa/g/cm$^3$). For example, the specific strength of the composite material can be greater than or equal to 2,250,000 PSI/lb/in$^3$ (560 MPa/g/cm$^3$), greater than or equal to 2,500,000 PSI/lb/in$^3$ (623 MPa/g/cm$^3$), greater than or equal to 2,750,000 PSI/lb/in$^3$ (685 MPa/g/cm$^3$), greater than or equal to 3,000,000 PSI/lb/in$^3$ (747 MPa/g/cm$^3$), greater than or equal to 3,250,000 PSI/lb/in$^3$ (810 MPa/g/cm$^3$), greater than or equal to 3,500,000 PSI/lb/in$^3$ (872 MPa/g/cm$^3$), greater than or equal to 3,750,000 PSI/lb/in$^3$ (934 MPa/g/cm$^3$), or greater than or equal to 4,000,000 PSI/lb/in$^3$ (996 MPa/g/cm$^3$). For further example, the specific strength of the composite material can be between 2,000,000 PSI/lb/in$^3$ (498 MPa/g/cm$^3$) and 4,000,000 PSI/lb/in$^3$ (996 MPa/g/cm$^3$), between 2,250,000 PSI/lb/in$^3$ (560 MPa/g/cm$^3$) and 4,000,000 PSI/lb/in$^3$ (996 MPa/g/cm$^3$), between 2,500,000 PSI/lb/in$^3$ (623 MPa/g/cm$^3$) and 4,000,000 PSI/lb/in$^3$ (996 MPa/g/cm$^3$), between 2,750,000 PSI/lb/in$^3$ (685 MPa/g/cm$^3$) and 4,000,000 PSI/lb/in$^3$ (996 MPa/g/cm$^3$), or between 3,000,000 PSI/lb/in$^3$ (747 MPa/g/cm$^3$) and 4,000,000 PSI/lb/in$^3$ (996 MPa/g/cm$^3$).

In embodiments where the body of the club head 100 includes the stronger, more flexible, and/or lighter material comprising a composite material, the specific flexibility of the composite material can be greater than or equal to 0.0150, greater than or equal to 0.0175, greater than or equal to 0.0200, greater than or equal to 0.0225, greater than or equal to 0.0250, greater than or equal to 0.0275, greater than or equal to 0.0300, greater than or equal to 0.0325, greater than or equal to 0.0350, greater than or equal to 0.0375, or greater than or equal to 0.0400. Further, the specific flexibility of the composite material can be between 0.0150 and 0.0400, between 0.0200 and 0.0400, between 0.0250 and 0.0400, or between 0.0300 and 0.0400.

In some embodiments, the specific strength of the composite material can be greater than the specific strength of known composite materials used in current golf club head bodies. Increased specific strength can result in reduced club head weight or increased discretionary weight compared to a similar club head with known composite materials. In some embodiments, the specific flexibility of the composite material can be greater than the specific flexibility of known composite materials used in current golf club head bodies. Increased specific flexibility can result in increased flexibility of the club head body, thereby increasing energy transfer to a golf ball on impact, compared to a similar club head with known composite materials.

In embodiments where the body 10 of the club head 100 comprises the stronger, more flexible, and/or lighter composite material, the composite material can have any composition capable of achieving the desired specific strength and specific flexibility. In many embodiments, the composite material can be positioned on at least a portion of the crown 30, the sole 34, the front end 22, the rear end 24, the heel portion 26, the toe potion 28, or a combination of the above described positions on the body 10 of the club head 100. In some embodiments, the composite material is positioned on a portion of the crown 30 of the club head 100. In these embodiments, the composite material extends through an outer surface to an inner surface of the crown 30 defining a thickness. In many embodiments, the thickness can be less than or equal to 1.00 mm, less than or equal to 0.95 mm, less than or equal to 0.90 mm, less than or equal to 0.85 mm, less than or equal to 0.80 mm ,less than or equal to 0.75 mm, less than or equal to 0.70 mm, less than or equal to 0.65 mm, less than or equal to 0.60 mm, less than or equal to 0.55 mm, or less than or equal to 0.50 mm.

b). Faceplate Comprising Stronger, More Flexible, Lighter Material

In many embodiments, the club head faceplate 14 comprises the stronger, more flexible, and/or lighter material. In some embodiments, the entire faceplate 14 can comprise the material. In some embodiments, at least a portion of the faceplate 14 can comprise the material, with the remainder of the faceplate 14 comprising a different material or plurality of materials. In many embodiments, the material on the faceplate 14 is formed from a sheet material to form at least a portion of the faceplate 14.

In some embodiments, the material comprises greater specific strength and/or greater specific flexibility compared to current materials used in golf club heads after being processed (e.g. heat treated with specific parameters). In other embodiments, the material comprises greater specific strength and/or greater specific flexibility compared to current materials used in golf club heads without heat treatments or other processing techniques. In these embodiments, the material can be processed (e.g. heat treated) to further increase the specific strength and/or specific flexibility compared to current materials used in golf club heads.

i). Faceplate Comprising Stronger, More Flexible, Lighter Steel Alloy

FIG. 3 illustrates the ranges of specific strength (i.e. strength-to-weight ratio) and specific flexibility (i.e. strength-to-modulus ratio) of various known steel alloy-type materials used in current golf club head faceplates compared to the stronger, more flexible, and/or lighter materials comprising steel alloys described herein. Many known steel alloys used in current golf club head faceplates have a specific strength less than 828,000 PSI/lb/in$^3$ (206 MPa/g/cm$^3$), a specific flexibility less than 0.0082, a yield strength less than 220,000 PSI (1517 MPa), and an elastic modulus greater than 35,000,000 PSI (241,317 MPa).

In embodiments where the faceplate of the club head 100 includes the stronger, more flexible, and/or lighter material comprising a steel alloy, the specific strength of the steel alloy can be greater than or equal to 650,000 PSI/lb/in$^3$ (162 MPa/g/cm$^3$).

For example, the specific strength of the steel alloy can be greater than or equal to 700,000 PSI/lb/in$^3$ (174 MPa/g/cm$^3$), greater than or equal to 750,000 PSI/lb/in$^3$ (187 MPa/g/cm$^3$), greater than or equal to 800,000 PSI/lb/in$^3$ (199 MPa/g/cm$^3$), greater than or equal to 810,000 PSI/lb/in$^3$ (202 MPa/g/cm$^3$), greater than or equal to 820,000 PSI/lb/in$^3$ (204 MPa/g/cm$^3$), greater than or equal to 830,000 PSI/lb/in$^3$ (207 MPa/g/cm$^3$), greater than or equal to 840,000 PSI/lb/in$^3$ (209 MPa/g/cm$^3$), greater than or equal to 850,000 PSI/lb/in$^3$ (212 MPa/g/cm$^3$), greater than or equal to 875,000 PSI/lb/in$^3$ (218 MPa/g/cm$^3$), greater than or equal to 900,000 PSI/lb/in$^3$ (224 MPa/g/cm$^3$), greater than or equal to 925,000 PSI/lb/in$^3$ (230 MPa/g/cm$^3$), greater than or equal to 950,000 PSI/lb/in$^3$ (237 MPa/g/cm$^3$), greater than or equal to 975,000 PSI/lb/in$^3$ (243 MPa/g/cm$^3$), greater than or equal to 1,000,000 PSI/lb/in$^3$ (249 MPa/g/cm$^3$), greater than or equal to 1,050,000 PSI/lb/in$^3$ (262 MPa/g/cm$^3$), greater than or equal to 1,100,000 PSI/lb/in$^3$ (274 MPa/g/cm$^3$), greater than or equal to 1,115,000 PSI/lb/in$^3$ (278 MPa/g/cm$^3$), greater than or equal to 1,120,000 PSI/lb/in$^3$ (279 MPa/g/cm$^3$), greater than or equal to 1,130,000 PSI/lb/in$^3$ (282 MPa/g/cm$^3$), greater than or equal to 1,140,000 PSI/lb/in$^3$ (284 MPa/g/cm$^3$), greater than or equal to 1,150,000 PSI/lb/in$^3$ (287 MPa/g/cm$^3$), greater than or equal to 1,175,000 PSI/lb/in$^3$ (293 MPa/g/cm$^3$), or greater than or equal to 1,200,000 PSI/lb/in$^3$ (299 MPa/g/cm$^3$).

For further example, the specific strength of the steel alloy can be between 830,000 PSI/lb/in$^3$ (207 MPa/g/cm$^3$) and 1,200,000 PSI/lb/in$^3$ (299 MPa/g/cm$^3$), between 850,000 PSI/lb/in$^3$ (212 MPa/g/cm$^3$) and 1,200,000 PSI/lb/in$^3$ (299 MPa/g/cm$^3$), between 900,000 PSI/lb/in$^3$ (224 MPa/g/cm$^3$) and 1,200,000 PSI/lb/in$^3$ (299 MPa/g/cm$^3$), between 950,000 PSI/lb/in$^3$ (237 MPa/g/cm$^3$) and 1,200,000 PSI/lb/in$^3$ (299 MPa/g/cm$^3$), or between 1,000,000 PSI/lb/in$^3$ (249 MPa/g/cm$^3$) and 1,200,000 PSI/lb/in$^3$ (299 MPa/g/cm$^3$).

In embodiments where the faceplate of the club head 100 includes the stronger, more flexible, and/or lighter material comprising a steel alloy, the specific flexibility of the steel alloy can be greater than or equal to 0.0060. For example, the specific flexibility of the steel alloy can be greater than or equal to 0.0065, greater than or equal to 0.0070, greater than or equal to 0.0075, greater than or equal to 0.0080, greater than or equal to 0.0082, greater than or equal to 0.0085, greater than or equal to 0.0090, greater than or equal to 0.0095, greater than or equal to 0.0100, greater than or equal to 0.0105, greater than or equal to 0.0110, greater than or equal to 0.0115, greater than or equal to 0.0120, greater than or equal to 0.0125, greater than or equal to 0.0130, greater than or equal to 0.0135, greater than or equal to 0.0140, greater than or equal to 0.0145, or greater than or equal to 0.0150. Further, the specific flexibility of the steel alloy can be between 0.0080 and 0.0150, between 0.0085 and 0.0150, between 0.0090 and 0.0150, between 0.0095 and 0.0150, between 0.100 and 0.0150, between 0.0080 and 0.0140, between 0.0090 and 0.0140, or between 0.0100 and 0.0140.

In embodiments where the faceplate of the club head 100 includes the stronger, more flexible, and/or lighter material comprising a steel alloy, the yield strength of the steel alloy can be greater than or equal to 220,000 PSI (1517 MPa), greater than or equal to 230,000 PSI (1586 MPa), greater than or equal to 240,000 PSI (1655 MPa), greater than or equal to 250,000 PSI (1724 MPa), greater than or equal to 260,000 PSI (1793 MPa), greater than or equal to 270,000 PSI (1862 MPa), greater than or equal to 280,000 PSI (1931 MPa), greater than or equal to 290,000 PSI (1999 MPa), or greater than or equal to 300,000 PSI (2068 MPa). Further, the yield strength of the steel alloy can be between 220,000 PSI (1517 MPa) and 300,000 PSI (2068 MPa), between 230,000 PSI (1586 MPa) and 300,000 PSI (2068 MPa), between 250,000 PSI (1724 MPa) and 300,000 PSI (2068 MPa), between 260,000 PSI (1793 MPa) and 300,000 PSI (2068 MPa), or between 270,000 PSI (1862 MPa) and 300,000 PSI (2068 MPa).

In embodiments where the faceplate of the club head 100 includes the stronger, more flexible, and/or lighter material comprising a steel alloy, the elastic modulus of the steel alloy can be less than or equal to 35,000,000 PSI (241,317 MPa), less than or equal to 32,500,000 PSI (224,080 MPa), less than or equal to 30,000,000 PSI (206,843 MPa), less than or equal to 28,500,000 PSI (196,501 MPa), less than or equal to 27,500,000 PSI (189,606 MPa), less than or equal to 25,000,000 PSI (172,369 MPa), or less than or equal to 22,500,000 PSI (137,895 MPa). Further, the elastic modulus of the steel alloy can be between 22,500,000 PSI (137,895 MPa) and 35,000,000 PSI (241,317 MPa), between 22,500,000 PSI (137,895 MPa) and 32,500,000 PSI (224,080 MPa), between 22,500,000 PSI (137,895 MPa) and 30,000,000 PSI (206,843 MPa), or between 22,500,000 PSI (137,895 MPa) and 27,500,000 PSI (189,606 MPa).

In embodiments where the faceplate of the club head 100 includes the stronger, more flexible, and/or lighter material comprising a steel alloy, the density of the steel alloy can be less than or equal to 0.40 lb/in$^3$ (11.0 g/cm$^3$), less than or equal to 0.35 lb/in$^3$ (9.7 g/cm$^3$), less than or equal to 0.30 lb/in$^3$ (8.3 g/cm$^3$), less than or equal to 0.29 lb/in$^3$ (8.0 g/cm$^3$), less than or equal to 0.28 lb/in$^3$ (7.8 g/cm$^3$), less than or equal to 0.27 lb/in$^3$ (7.5 g/cm$^3$), less than or equal to 0.26 lb/in$^3$ (7.2 g/cm$^3$), or less than or equal to 0.25 lb/in$^3$ (6.9 g/cm$^3$). Further, the density of the steel alloy can be between 0.25 lb/in$^3$ (6.9 g/cm$^3$) and 0.40 lb/in$^3$ (11.0 g/cm$^3$), between 0.25 lb/in$^3$ (6.9 g/cm$^3$) and 0.35 lb/in$^3$ (9.7 g/cm$^3$), between 0.25 lb/in$^3$ (6.9 g/cm$^3$) and 0.30 lb/in$^3$ (8.3 g/cm$^3$), or between 0.25 lb/in$^3$ (6.9 g/cm$^3$) and 0.28 lb/in$^3$ (7.8 g/cm$^3$).

Referring to FIG. 3, the specific strength and/or the specific flexibility of the stronger, more flexible, and/or lighter steel alloy are shifted to a region of the graph outside of the current steel alloy-type materials used in golf club head faceplates. For example, the specific strength of the steel alloy can be greater than the specific strength of known steel alloy-type materials used in current golf club head faceplates (e.g. material B compared to material A in FIG. 5). Increased specific strength can result in reduced club head weight or increased discretionary weight compared to a similar club head with known steel alloys. For further example, the specific flexibility of the steel alloy can be greater than the specific flexibility of known steel alloy-type materials used in current golf club head faceplates (e.g. material C compared to material A in FIG. 5). Increased specific flexibility can result in increased flexibility of the faceplate, thereby increasing energy transfer to a golf ball on impact, compared to a similar club head with known steel alloys. In many embodiments, the specific strength and the specific flexibility of the steel alloy can be greater than the specific strength and specific flexibility, respectively, of known steel alloy-type materials (e.g. material D compared to material A in FIG. 5).

In embodiments where the faceplate 14 of the club head 100 comprises the stronger, more flexible, and/or lighter steel alloy, the steel alloy can have any composition capable of achieving the desired specific strength and specific flexibility. For example, the steel alloy can comprise C300 steel having 18.0-19.0 wt % nickel, 8.5-9.5 wt % cobalt, 4.6-5.2 wt % molybdenum, with the remaining alloy composition being iron and other trace elements. In some embodiments, trace elements of the steel alloy comprising C300 steel can include 0.5-0.8 wt % titanium, 0.05-0.15 wt % aluminum, less than 0.5 wt % chromium, less than 0.5 wt % copper, less than 0.1 wt % manganese, less than 0.1 wt % silicon, less than 0.3 wt % carbon, less than 0.01 wt % phosphorus, or less than 0.01 wt % sulfur. In this example, the density of the C300 steel alloy is 0.289 lb/in$^3$ (7.99 g/cm$^3$).

Further, the stronger, more flexible, and/or lighter steel alloy can be subject to a heat treatment process to achieve the specific strength and the specific flexibility described above. For example, in one embodiment, the steel alloy comprising C300 can be subject to a heat treatment including heating the steel alloy to approximately 830 degrees Celsius for approximately 60 minutes, and subsequently heating the steel alloy to approximately 480 degrees Celsius for approximately 4 hours. In this example, the heat treatment process results in the C300 steel alloy steel having a yield strength of 268,000 PSI (1848 MPa), an elastic modulus of 23,700,000 PSI (163,410 MPa), a specific strength of 928,428 PSI/lb/in$^3$ (231 MPa/g/cm$^3$), and a specific flexibility of 0.0113. In other embodiments, the heat treatment parameters can vary to achieve the desired specific strength and specific flexibility parameters. For example, the steel alloy comprising C300 can be subject to a heat treatment including heating the steel alloy to 750-900 degrees Celsius for 45-90 minutes, followed by heating the steel alloy to 400-550 degrees for 3-5 hours. Further, in other embodiments, the heat treatment parameters can vary with different steel alloy compositions to achieve the desired specific strength and specific flexibility parameters.

For further example, the stronger, more flexible, and/or lighter steel alloy can comprise C350 steel having 11.0-13.0 wt % cobalt, 18.0-19.0 wt % nickel, 4.5-5.5 wt % molybdenum, 1.0-2.0 wt % titanium, with the remaining alloy composition being iron and other trace elements. In some embodiments, trace elements of the steel alloy comprising C350 steel can include 0.05-0.15 wt % aluminum, less than or equal to 0.03 wt % carbon, less than or equal to 0.01 wt % phosphorus, less than or equal to 0.10 wt % silicon, less than or equal to 0.50 wt % copper, less than or equal to 0.10 wt % manganese, less than or equal to 0.01 wt % sulfur, and less than or equal to 0.50 wt % chromium. In this example, the density of the C350 steel alloy is 0.292 lb/in$^3$ (8.08 g/cm$^3$).

Further, the stronger, more flexible, and/or lighter_steel alloy can be subject to a heat treatment process to achieve the specific strength and the specific flexibility described above. For example, in one embodiment, the steel alloy comprising C350 can be subject to a heat treatment including heating the steel alloy to approximately 830 degrees Celsius for approximately 60 minutes, and subsequently heating the steel alloy to approximately 512 degrees Celsius for approximately 4 hours. In this example, the heat treatment process results in the C350 steel alloy steel having a yield strength of 349,000 PSI (2406 MPa), an elastic modulus of 26,900,000 PSI (185,470 MPa), a specific strength of 1,195,615 PSI/lb/in$^3$ (298 MPa/g/cm$^3$), and a specific flexibility of 0.0130. In other embodiments, the heat treatment parameters can vary to achieve the desired specific strength and specific flexibility parameters. For example, the steel alloy comprising C350 can be subject to a heat treatment including heating the steel alloy to 750-900 degrees Celsius for 45-90 minutes, and subsequently heating the steel alloy to 450-550 degrees Celsius for 5-7 hours. Further, in other embodiments, the heat treatment parameters can vary with different steel alloy compositions to achieve the desired specific strength and specific flexibility parameters.

For further example, the stronger, more flexible, and/or lighter steel alloy can comprise a Ni—Co—Cr steel alloy having 2.0-3.0 wt % chromium, 14.0-16.0 wt % cobalt, 10.0-12.0 wt % nickel, 1.0-2.0 wt % molybdenum, with the remaining alloy composition being iron and other trace elements. In some embodiments, trace elements of the Ni—Co—Cr steel alloy can include less than or equal to 0.35 wt % carbon. In this example, the density of the Ni—Co—Cr steel alloy is 0.288 lb/in$^3$ (7.97 g/cm$^3$).

Further, the stronger, more flexible, and/or lighter steel alloy can be subject to a heat treatment process to achieve the specific strength and the specific flexibility described above. For example, the steel alloy comprising the Ni—Co—Cr steel alloy can be subject to a heat treatment including heating the steel alloy to approximately 915 degrees Celsius for approximately 60 minutes, followed by a cryogenic freezing in liquid nitrogen at −73 degrees Celsius for approximately 60 minutes, and subsequently heating the steel alloy to approximately 482 degrees Celsius for approximately 6 hours. In this example, the heat treatment process results in the Ni—Co—Cr steel alloy steel having a yield strength of 275,000 PSI (1896 MPa), an elastic modulus of 25,900,000 PSI (178,570 MPa), a specific strength of 954,861 PSI/lb/in$^3$ (238 MPa/g/cm$^3$), and a specific flexibility of 0.0106. In other embodiments, the heat treatment parameters can vary to achieve the desired specific strength and specific flexibility parameters. For example, the Ni—Co—Cr steel alloy can be subject to a heat treatment including heating the steel alloy to 850-950 degrees Celsius for 45-90 minutes, followed by an optional cryogenic freezing in liquid nitrogen at for 45-90 minutes, and subsequently heating the steel alloy to 450-550 degrees Celsius for 4-6 hours. Further, in other embodiments, the heat treatment parameters can vary with different steel alloy compositions to achieve the desired specific strength and specific flexibility parameters.

For further example, the stronger, more flexible, and/or lighter steel alloy can comprise a Ni—Co—Cr steel alloy having 2.0-3.0 wt % chromium, 15.0-16.5 wt % cobalt, 12.0-13.0 wt % nickel, 1.0-2.0 wt % molybdenum, with the remaining alloy composition being iron and other trace elements. In some embodiments, trace elements of the Ni—Co—Cr steel alloy can include less than or equal to 0.4 wt % carbon. In this example, the density of the Ni—Co—Cr steel alloy is 0.284 lb/in$^3$ (7.86 g/cm$^3$).

Further, the stronger, more flexible, and/or lighter steel alloy can be subject to a heat treatment process to achieve the specific strength and the specific flexibility described above. For example, the steel alloy comprising the Ni—Co—Cr steel alloy can be subject to a heat treatment including heating the steel alloy to approximately 968 degrees Celsius for approximately 60 minutes, followed by a cryogenic freezing in liquid nitrogen at −73 degrees Celsius for approximately 60 minutes, heating the steel alloy to approximately 482 degrees Celsius for approximately 2.5 hours, followed by a cryogenic freezing in liquid nitrogen at −73 degrees Celsius for approximately 60 minutes, and heating the steel alloy to approximately 482 degrees Celsius for approximately 2.5 hours, followed by a cryogenic freezing in liquid nitrogen at −73 degrees Celsius for approximately 60 minutes. In this example, the heat treatment process results in the Ni—Co—Cr steel alloy steel having a yield strength of 300,000 PSI (2068 MPa), an elastic modulus of 27,100,000 PSI (186,850 MPa), a specific strength of 1,056,338 PSI/lb/in$^3$ (263 MPa/g/cm$^3$), and a specific flexibility of 0.0111. In other embodiments, the heat treatment parameters can vary to achieve the desired specific strength and specific flexibility parameters. For example , the Ni—Co—Cr steel alloy can be subject to a heat treatment including heating the steel alloy to 900-1050 degrees Celsius for 45-60 minutes, followed by an optional cryogenic freezing in liquid nitrogen for 45-90 minutes, heating the steel alloy to 400-550 degrees Celsius for 1.5-3.5 hours, followed by an optional cryogenic freezing in liquid nitrogen for 45-90 minutes, and heating the steel alloy to approximately 400-550 degrees Celsius for 1.5-3.5 hours, followed by an optional cryogenic freezing in liquid nitrogen for approximately 45-90 minutes. Further, in other embodiments, the heat treatment parameters can vary with different steel alloy compositions to achieve the desired specific strength and specific flexibility parameters.

For further example, the stronger, more flexible, and/or lighter steel alloy can comprise 565 steel having 11.0-12.5 wt % chromium, 1.0-2.0 wt % cobalt, 11.0-12.5 wt % nickel, 0.5-1.5 wt % molybdenum, 1.5-2.5 wt % titanium, with the remaining alloy composition being iron and other trace elements. In some embodiments, trace elements of the steel alloy comprising 565 steel can include less than or equal to 0.05 wt % carbon, less than or equal to 0.04 wt % phosphorus, less than or equal to 0.03 wt % sulfur, and less than or equal to 0.5 wt % aluminum. In this example, the density of the 565 steel alloy is 0.284 lb/in$^3$ (7.87 g/cm$^3$).

Further, the stronger, more flexible, and/or lighter steel alloy can be subject to a heat treatment process to achieve the specific strength and the specific flexibility described above. In this example, the 565 steel alloy scan have a yield strength of 265,000 PSI (1827 MPa), an elastic modulus of 24,000,000 PSI (165,470 MPa), a specific strength of 931,799 PSI/lb/in$^3$ (232 MPa/g/cm$^3$), and a specific flexibility of 0.0110. In other embodiments, the heat treatment parameters can vary to achieve the desired specific strength and specific flexibility parameters. Further, in other embodiments, the heat treatment parameters can vary with different steel alloy compositions to achieve the desired specific strength and specific flexibility parameters.

For further example, the stronger, more flexible, and/or lighter steel alloy can comprise a quench and tempered steel alloy having 3.0-4.5 wt % nickel, 1.0-2.0 wt % silicon, 0.75-1.5 wt % chromium, less than 1.0 wt % copper, less than 1.25 wt % manganese, less than 1.0 wt % molybdenum, less than 0.75 wt % vanadium, with the remaining alloy composition being iron and other trace elements. In this example, the density of the quench and tempered steel alloy is 0.284 lb/in$^3$ (7.86 g/cm$^3$).

Further, the stronger, more flexible, and/or lighter steel alloy can be subject to a heat treatment process to achieve the specific strength and the specific flexibility described above. For example, the quench and tempered steel alloy can be subject to a heat treatment including heating the steel alloy at 918 degrees Celsius for approximately 60 minutes, followed by nitrogen cooling and a cryogenic freezing at −73 degrees Celsius for approximately 8 hours, followed by heating the steel alloy at approximately 260 degrees Celsius for approximately 2 hours. In this example, the quench and tempered steel alloy scan have a yield strength of 240,000 PSI (1655 MPa), an elastic modulus of 23,600,000 PSI (162,720 MPa), a specific strength of 845,188 PSI/lb/in$^3$ (211 MPa/g/cm$^3$), and a specific flexibility of 0.0102. In other embodiments, the heat treatment parameters can vary to achieve the desired specific strength and specific flexibility parameters. For example, the quench and tempered steel alloy can be subject to a heat treatment including heating the steel alloy at 850-1050 degrees Celsius for 45-90 minutes, followed by nitrogen cooling and an optional cryogenic freezing at for 6-10 hours, followed by heating the steel alloy at 200-350 degrees Celsius for 3-5 hours. Further, in other embodiments, the heat treatment parameters can vary with different steel alloy compositions to achieve the desired specific strength and specific flexibility parameters.

ii). Faceplate Comprising Stronger, More Flexible, Lighter Titanium Alloy

FIG. 4 illustrates the ranges of specific strength (i.e. strength-to-weight ratio) and specific flexibility (i.e. strength-to-modulus ratio) of various known titanium alloy-type materials used in current golf club head faceplates compared to the stronger, more flexible, and/or lighter titanium faceplate materials described herein. Many known titanium alloys used in current golf club head faceplates have a specific strength less than 900,000 PSI/lb/in$^3$ (224 MPa/g/cm$^3$), a specific flexibility less than 0.0090, a yield strength less than 160,000 PSI (1103 MPa), and an elastic modulus greater than 18,500,000 PSI (127,553 MPa).

In embodiments where the faceplate of the club head 100 includes the stronger, more flexible, and/or lighter material comprising a titanium alloy, the specific strength of the titanium alloy can be greater than or equal to 900,000 PSI/lb/in$^3$ (224 MPa/g/cm$^3$).

For example, the specific strength of the titanium alloy can be greater than or equal to 910,000 PSI/lb/in$^3$ (227 MPa/g/cm$^3$), greater than or equal to 920,000 PSI/lb/in$^3$ (229 MPa/g/cm$^3$), greater than or equal to 930,000 PSI/lb/in$^3$ (232 MPa/g/cm$^3$), greater than or equal to 930,500 PSI/lb/in$^3$ (232 MPa/g/cm$^3$), greater than or equal to 940,000 PSI/lb/in$^3$ (234 MPa/g/cm$^3$), greater than or equal to 950,000 PSI/lb/in$^3$ (237 MPa/g/cm$^3$), greater than or equal to 960,000 PSI/lb/in$^3$ (239 MPa/g/cm$^3$), greater than or equal to 970,000 PSI/lb/in$^3$ (242 MPa/g/cm$^3$), greater than or equal to 980,000 PSI/lb/in$^3$ (244 MPa/g/cm$^3$), greater than or equal to 990,000 PSI/lb/in$^3$ (247 MPa/g/cm$^3$), greater than or equal to 1,000,000 PSI/lb/in$^3$ (249 MPa/g/cm$^3$), greater than or equal to 1,050,000 PSI/lb/in$^3$ (262 MPa/g/cm$^3$), greater than or equal to 1,075,000 PSI/lb/in$^3$ (268 MPa/g/cm$^3$), greater than or equal to 1,100,000 PSI/lb/in$^3$ (274 MPa/g/cm$^3$), greater than or equal to 1,150,000 PSI/lb/in$^3$ (286 MPa/g/cm$^3$), greater than or equal to 1,120,000 PSI/lb/in$^3$ (279 MPa/g/cm$^3$), greater than or equal to 1,130,000 PSI/lb/in$^3$ (282 MPa/g/cm$^3$), greater than or equal to 1,140,000 PSI/lb/in$^3$ (284 MPa/g/cm$^3$), greater than or equal to 1,150,000 PSI/lb/in$^3$ (287 MPa/g/cm$^3$), greater than or equal to 1,175,000 PSI/lb/in$^3$ (293 MPa/g/cm$^3$), greater than or equal to 1,200,000 PSI/lb/in$^3$ (299 MPa/g/cm$^3$), greater than or equal to 1,250,000 PSI/lb/in$^3$ (312 MPa/g/cm$^3$), or greater than or equal to 1,300,000 PSI/lb/in$^3$ (324 Mpa/g/cm$^3$).

For further example, the specific strength of the titanium alloy can be between 900,000 PSI/lb/in$^3$ (224 MPa/g/cm$^3$) and 1,300,000 PSI/lb/in$^3$ (324 Mpa/g/cm$^3$), between 920,000 PSI/lb/in$^3$ (229 MPa/g/cm$^3$) and 1,300,000 PSI/lb/in$^3$ (324 Mpa/g/cm$^3$), between 930,500 PSI/lb/in$^3$ (232 MPa/g/cm$^3$) and 1,300,000 PSI/lb/in$^3$ (324 Mpa/g/cm$^3$), between 950,000 PSI/lb/in$^3$ (237 MPa/g/cm$^3$) and 1,300,000 PSI/lb/in$^3$ (324 Mpa/g/cm$^3$), between 970,000 PSI/lb/in$^3$ (242 MPa/g/cm$^3$) and 1,300,000 PSI/lb/in$^3$ (324 Mpa/g/cm$^3$), between 990,000 PSI/lb/in$^3$ (247 MPa/g/cm$^3$) and 1,300,000 PSI/lb/in$^3$ (324 Mpa/g/cm$^3$), between 1,050,000 PSI/lb/in$^3$ (262 MPa/g/cm$^3$) and 1,300,000 PSI/lb/in$^3$ (324 Mpa/g/cm$^3$), or between 1,075,000 PSI/lb/in$^3$ (268 MPa/g/cm$^3$) and 1,300,000 PSI/lb/in$^3$ (324 Mpa/g/cm$^3$).

In embodiments where the faceplate of the club head 100 includes the stronger, more flexible, and/or lighter titanium alloy, the specific flexibility of the titanium alloy can be greater than or equal to 0.0075. For example, the specific flexibility of the titanium alloy can be greater than or equal to 0.0080, greater than or equal to 0.0085, greater than or equal to 0.0090, greater than or equal to 0.0091, greater than or equal to 0.0092, greater than or equal to 0.0093, greater than or equal to 0.0094, greater than or equal to 0.0095, greater than or equal to 0.0096, greater than or equal to 0.0097, greater than or equal to 0.0098, greater than or equal to 0.0099, greater than or equal to 0.0100, greater than or equal to 0.0105, greater than or equal to 0.0110, greater than or equal to 0.0115, greater than or equal to 0.0120, greater than or equal to 0.0125, greater than or equal to 0.0130, greater than or equal to 0.0135, or greater than or equal to 0.0140.

For further example, the specific flexibility of the titanium alloy can be between 0.0080 and 0.0140, between 0.0085 and 0.0140, between 0.0090 and 0.0140, between 0.0100 and 0.0140, between 0.0105 and 0.0140, between 0.0110 and 0.0140, between 0.0115 and 0.0140, between 0.0120 and 0.0140, between 0.0125 and 0.0140, between 0.0130 and 0.0140, or between 0.0135 and 0.0140.

In embodiments where the faceplate of the club head 100 includes the stronger, more flexible, and/or lighter material comprising a titanium alloy, the yield strength of the titanium alloy can be greater than or equal to 160,000 PSI (1103 MPa), greater than or equal to 161,000 PSI (1110 MPa), greater than or equal to 162,000 PSI (1117 MPa), greater than or equal to 163,000 PSI (1124 MPa), greater than or equal to 164,000 PSI (1131 MPa), greater than or equal to 165,000 PSI (1138 MPa), greater than or equal to 170,000 PSI (1172 MPa), greater than or equal to 175,000 PSI (1207 MPa), greater than or equal to 180,000 PSI (1241 MPa), greater than or equal to 185,000 PSI (1276 MPa), greater than or equal to 190,000 PSI (1310 MPa), greater than or equal to 195,000 PSI (1344 MPa), or greater than or equal to 200,000 PSI (1379 MPa). Further, the yield strength of the titanium alloy can be between 160,000 PSI (1103 MPa) and 200,000 PSI (1379 MPa), between 163,000 PSI (1124 MPa) and 200,000 PSI (1379 MPa), between 165,000 PSI (1138 MPa) and 200,000 PSI (1379 MPa), between 170,000 PSI (1172 MPa) and 200,000 PSI (1379 MPa), between 175,000 PSI (1207 MPa) and 200,000 PSI (1379 MPa), or between 180,000 PSI (1241 MPa) and 200,000 PSI (1379 MPa).

In embodiments where the faceplate of the club head 100 includes the stronger, more flexible, and/or lighter material comprising a titanium alloy, the elastic modulus of the titanium alloy can be less than or equal to 18,500,000 PSI (127,553 MPa), less than or equal to 18,000,000 PSI (124,106 MPa), less than or equal to 17,500,000 PSI (120,658 MPa), less than or equal to 17,000,000 PSI (117,211 MPa), less than or equal to 16,500,000 PSI (113,764 MPa), less than or equal to 16,000,000 PSI (110,316 MPa), less than or equal to 15,500,000 PSI (106,869 MPa), less than or equal to 15,000,000 PSI (103,421 MPa), less than or equal to 14,500,000 PSI (99,974 MPa), less than or equal to 14,000,000 PSI (96,527 MPa), less than or equal to 13,500,000 PSI (93,079 MPa), less than or equal to 13,000,000 PSI (89,632 MPa), less than or equal to 12,500,000 PSI (86,184 MPa), or less than or equal to 12,000,000 PSI (82,737 MPa). Further, the elastic modulus of the titanium alloy can be between 14,000,000 PSI (96,527 MPa) and 18,500,000 PSI (127,553 MPa), between 14,000,000 PSI (96,527 MPa) and 18,000,000 PSI (124,106 MPa), between 14,000,000 PSI (96,527 MPa) and 17,500,000 PSI (120,658 MPa), between 14,000,000 PSI (96,527 MPa) and 17,000,000 PSI (117,211 MPa), between 14,000,000 PSI (96,527 MPa) and 16,500,000 PSI (113,764 MPa), between 14,000,000 PSI (96,527 MPa) and 16,000,000 PSI (110,316 MPa), between 14,000,000 PSI (96,527 MPa) and 15,500,000 PSI (106,869 MPa), or between 14,000,000 PSI (96,527 MPa) and 15,000,000 PSI (103,421 MPa).

In embodiments where the faceplate of the club head 100 includes the stronger, more flexible, and/or lighter material comprising a titanium alloy, the density of the titanium alloy can be less than or equal to 0.30 lb/in$^3$ (8.3 g/cm$^3$), less than or equal to 0.25 lb/in$^3$ (6.9 g/cm$^3$), less than or equal to 0.20 lb/in$^3$ (5.5 g/cm$^3$), less than or equal to 0.195 lb/in$^3$ (5.40 g/cm$^3$), less than or equal to 0.19 lb/in$^3$ (5.3 g/cm$^3$), less than or equal to 0.185 lb/in$^3$ (5.12 g/cm$^3$), less than or equal to 0.18 lb/in$^3$ (5.0 g/cm$^3$), less than or equal to 0.175 lb/in$^3$ (4.84 g/cm$^3$), less than or equal to 0.17 lb/in$^3$ (4.7 g/cm$^3$), less than or equal to 0.165 lb/in$^3$ (4.57 g/cm$^3$), or less than or equal to 0.16 lb/in$^3$ (4.4 g/cm$^3$). Further, the density of the titanium alloy can be between 0.17 lb/in$^3$ (4.7 g/cm$^3$) and 0.30 lb/in$^3$ (8.3 g/cm$^3$), between 0.17 lb/in$^3$ (4.7 g/cm$^3$) and 0.25 lb/in$^3$ (6.9 g/cm$^3$), between 0.17 lb/in$^3$ (4.7 g/cm$^3$) and 0.20 lb/in$^3$ (5.5 g/cm$^3$), or between 0.17 lb/in$^3$ (4.7 g/cm$^3$) and 0.19 lb/in$^3$ (5.3 g/cm$^3$).

Referring to FIG. 4, the specific strength and/or the specific flexibility of the stronger, more flexible, and/or lighter titanium alloy are shifted to a region of the graph outside of the current titanium alloy-type materials used in golf club head faceplates. For example, the specific strength of the titanium alloy can be greater than the specific strength of known titanium alloy-type materials used in current golf club head faceplates (e.g. material B compared to material A in FIG. 5). Increased specific strength can result in reduced club head weight or increased discretionary weight compared to a similar club head with known titanium alloys. For further example, the specific flexibility of the titanium alloy can be greater than the specific flexibility of titanium alloy-type materials used in current golf club head faceplates (e.g. material C compared to material A in FIG. 5). Increased specific flexibility can result in increased flexibility of the faceplate, thereby increasing energy transfer to a golf ball on impact, compared to a similar club head with known titanium alloys. In many embodiments, the specific strength and the specific flexibility of the titanium alloy can be greater than the specific strength and specific flexibility, respectively, of known titanium alloy-type materials (e.g. material D compared to material A in FIG. 5).

In embodiments where the faceplate 14 of the club head 100 comprises the stronger, more flexible, and/or lighter titanium alloy, the titanium alloy can have any composition capable of achieving the desired specific strength and specific flexibility. For example, the titanium alloy can comprise Ti 3-8-6-4-4 having 3-4 wt % aluminum, 7.5-8.5 wt % vanadium, 5.5-6.5 wt % chromium, 3.5-4.5 wt % molybdenum, and 3.5-4.5 wt % zirconium, with the remaining alloy composition being titanium and other trace elements. In some embodiments, trace elements of the material comprising Ti 3-8-6-4-4 can include less than 0.05 wt % carbon, less than 0.03 wt % iron, less than 0.03 wt % nitrogen, or less than 0.14 wt % oxygen. In this example, the density of the material comprising Ti 3-8-6-4-4 titanium alloy is 0.175 lb/in$^3$ (4.83 g/cm$^3$).

Further, the stronger, more flexible, and/or lighter titanium alloy can be subject to a heat treatment process to achieve the specific strength and the specific flexibility described above. For example, in one embodiment, the titanium alloy comprising Ti 3-8-6-4-4 can be subject to a heat treatment including heating the titanium alloy to approximately 900 degrees Celsius for approximately 30 minutes, and subsequently heating the titanium alloy to approximately 480 degrees Celsius for approximately 16 hours. In this example, the heat treatment process results in the Ti 3-8-6-4-4 titanium alloy having a yield strength of 185,000 PSI (1276 MPa), an elastic modulus of 14,400,000 PSI (99,280 MPa), a specific strength of 1,060,172 PSI/lb/in$^3$ (264 MPa/g/cm$^3$), and a specific flexibility of 0.0128. In other embodiments, the heat treatment parameters can vary to achieve the desired specific strength and specific flexibility parameters. For example, the titanium alloy comprising Ti 3-8-6-4-4 can be subject to a heat treatment including heating the titanium alloy to 800-1000 degrees Celsius for 15-75 minutes, and subsequently heating the titanium alloy to 400-550 degrees Celsius for 10-20 hours. Further, in other embodiments, the heat treatment parameters can vary with different titanium alloy compositions to achieve the desired specific strength and specific flexibility parameters.

For further example, the stronger, more flexible, and/or lighter titanium alloy can comprise Ti 10-2-3 having 9-11 wt % vanadium, 1.6-2.2 wt % iron, and 2.6-3.4 wt % aluminum, with the remaining alloy composition being titanium and other trace elements. In some embodiments, trace elements of the titanium alloy comprising Ti 10-2-3 can include less than 0.05 wt % carbon, less than 0.05 wt % nitrogen, and less than 0.13 wt % oxygen. In this example, the density of the Ti 10-2-3 titanium alloy is 0.168 lb/in$^3$ (4.65 g/cm$^3$).

Further, the stronger, more flexible, and/or lighter titanium alloy can be subject to a heat treatment process to achieve the specific strength and the specific flexibility described above. For example, in one embodiment, the titanium alloy comprising Ti 10-2-3 can be subject to a heat treatment including heating the titanium alloy to approximately 760 degrees Celsius for approximately 30 minutes, and subsequently heating the titanium alloy to approximately 385 degrees Celsius for approximately 8 hours. In this example, the heat treatment process results in the Ti 10-2-3 titanium alloy having a yield strength of 180,000 PSI (1241 MPa), an elastic modulus of 16,000,000 PSI (110,320 MPa), a specific strength of 1,071,429 PSI/lb/in$^3$ (267 MPa/g/cm$^3$), and a specific flexibility of 0.0113. In other embodiments, the heat treatment parameters can vary to achieve the desired specific strength and specific flexibility parameters. For example, the titanium alloy comprising Ti 10-2-3 can be subject to a heat treatment including heating the titanium alloy to 700-825 degrees Celsius for 15-75 minutes, and subsequently heating the titanium alloy to 300-450 degrees Celsius for approximately 5-15 hours. Further, in other embodiments, the heat treatment parameters can vary with different titanium alloy compositions to achieve the desired specific strength and specific flexibility parameters.

For further example, the stronger, more flexible, and/or lighter titanium alloy can comprise Ti 15-3-3-3 having 14-16 wt % vanadium, 2.5-3.5 wt % chromium, and 2.5-3.5 wt % tin, with the remaining alloy composition being titanium and other trace elements. In some embodiments, trace elements of the titanium alloy comprising Ti 15-3-3-3 can include less than 0.05 wt % carbon, less than 0.25 wt % iron, less than 0.05 wt % nitrogen, and less than 0.13 wt % oxygen. In this example, the density of the Ti 15-3-3-3 titanium alloy is 0.172 lb/in$^3$ (4.76 g/cm$^3$).

Further, the stronger, more flexible, and/or lighter titanium alloy can be subject to a heat treatment process to achieve the specific strength and the specific flexibility described above. For example, in one embodiment, the titanium alloy comprising Ti 15-3-3-3 can be subject to a heat treatment including heating the titanium alloy to approximately 790 degrees Celsius for approximately 30 minutes, and subsequently heating the titanium alloy to approximately 480 degrees Celsius for approximately 8 hours. In this example, the heat treatment process results in the Ti 15-3-3-3 titanium alloy having a yield strength of 160,000 PSI (1103 MPa), an elastic modulus of 13,000,000 PSI (89,630 MPa), a specific strength of 930,774 PSI/lb/in$^3$ (232 MPa/g/cm$^3$), and a specific flexibility of 0.0123. In other embodiments, the heat treatment parameters can vary to achieve the desired specific strength and specific flexibility parameters. For example, the titanium alloy comprising Ti 15-3-3-3 can be subject to a heat treatment including heating the titanium alloy to 700-850 degrees Celsius for 15-75 minutes, and subsequently heating the titanium alloy to 400-550 degrees Celsius for 5-15 hours. Further, in other embodiments, the heat treatment parameters can vary with different titanium alloy compositions to achieve the desired specific strength and specific flexibility parameters.

For further example, the stronger, more flexible, and/or lighter titanium alloy can comprise Ti 15-5-3 having 15 wt % molybdenum, 5 wt % zirconium, 3 wt % aluminum, with the remaining alloy composition being titanium and other trace elements. In this example, the density of the Ti 15-5-3 titanium alloy is 0.181 lb/in$^3$ (5.01 g/cm$^3$).

Further, the stronger, more flexible, and/or lighter titanium alloy can be subject to a heat treatment process to achieve the specific strength and the specific flexibility described above. For example, in one embodiment, the titanium alloy comprising Ti 15-5-3 can be subject to a heat treatment including heating the titanium alloy to approximately 850 degrees Celsius for approximately 30 minutes, and subsequently heating the titanium alloy to approximately 500 degrees Celsius for approximately 6 hours. In this example, the heat treatment process results in the Ti 15-5-3 titanium alloy having a yield strength of 189,000 PSI (1303 MPa), an elastic modulus of 14,500,000 PSI (99,970 MPa), a specific strength of 1,044,199 PSI/lb/in$^3$ (260 MPa/g/cm$^3$), and a specific flexibility of 0.0130. In other embodiments, the heat treatment parameters can vary to achieve the desired specific strength and specific flexibility parameters. For example, the titanium alloy comprising Ti 15-5-3 can be subject to a heat treatment including heating the titanium alloy to 800-900 degrees Celsius for 15-75 minutes, and subsequently heating the titanium alloy to 400-600 degrees Celsius for 5-7 hours. Further, in other embodiments, the heat treatment parameters can vary with different titanium alloy compositions to achieve the desired specific strength and specific flexibility parameters.

For further example, the stronger, more flexible, and/or lighter titanium alloy can comprise Ti 185 having 7.5-8.5 wt % vanadium, 0.8-1.5 wt % aluminum, 4.0-6.0 wt % iron, with the remaining alloy composition being titanium and other trace elements. In some embodiments, trace elements of the titanium alloy comprising Ti 185 can include less than or equal to 0.07 wt % nitrogen, less than or equal to 0.05 wt % carbon, between 0.25-0.50 wt % oxygen, and between 0.80-1.5 wt % aluminum. In this example, the density of the Ti 185 titanium alloy is 0.168 lb/in$^3$ (4.65 g/cm$^3$).

Further, the stronger, more flexible, and/or lighter titanium alloy can be subject to a heat treatment process to achieve the specific strength and the specific flexibility described above. For example, in one embodiment, the titanium alloy comprising Ti 185 can be subject to a heat treatment including heating the titanium alloy to approximately 704 degrees Celsius for approximately 60 minutes, and subsequently heating the titanium alloy to approximately 482 degrees Celsius for approximately 2 hours. In this example, the heat treatment process results in the Ti 185 titanium alloy having a yield strength of 210,000 PSI (1448 MPa), an elastic modulus of 16,400,000 PSI (113,070 MPa), a specific strength of 1,250,000 PSI/lb/in$^3$ (311 MPa/g/cm$^3$), and a specific flexibility of 0.0128. For further example, in one embodiment, the titanium alloy comprising Ti 185 can be subject to a heat treatment including heating the titanium alloy to approximately 675 degrees Celsius for approximately 30 minutes. In this example, the heat treatment process results in the Ti 185 titanium alloy having a yield strength of 178,000 PSI (1227 MPa), an elastic modulus of 16,500,000 PSI (113,760 MPa), a specific strength of 1,059,524 PSI/lb/in$^3$ (264 MPa/g/cm$^3$), and a specific flexibility of 0.0108. In other embodiments, the heat treatment parameters can vary to achieve the desired specific strength and specific flexibility parameters. For example, the titanium alloy comprising Ti 185 can be subject to a heat treatment including heating the titanium alloy to 600-800 degrees Celsius for approximately 30-90 minutes, and/or subsequently heating the titanium alloy to approximately 400-550 degrees Celsius for approximately 1-3 hours. Further, in other embodiments, the heat treatment parameters can vary with different titanium alloy compositions to achieve the desired specific strength and specific flexibility parameters.

For further example, the stronger, more flexible, and/or lighter titanium alloy can comprise Ti 6-6-2 having 6.0 wt % vanadium, 6.0 wt % aluminum, 2.0 wt % tin, with the remaining alloy composition being titanium and other trace elements. In some embodiments, trace elements of the titanium alloy comprising Ti 6-6-2 can include less than or equal to 0.5 wt % copper, and less than or equal to 0.5 wt % iron. In this example, the density of the Ti 6-6-2 titanium alloy is 0.164 lb/in$^3$ (4.54 g/cm$^3$).

Further, the stronger, more flexible, and/or lighter titanium alloy can be subject to a heat treatment process to achieve the specific strength and the specific flexibility described above. For example, in one embodiment, the titanium alloy comprising Ti 6-6-2 can be subject to a heat treatment including heating the titanium alloy to approximately 900 degrees Celsius for approximately 30 minutes, followed by a water quench, and subsequently heating the titanium alloy to approximately 500 degrees Celsius for approximately 6 hours. In this example, the heat treatment process results in the Ti 6-6-2 titanium alloy having a yield strength of 161,000 PSI (1110 MPa), an elastic modulus of 16,200,000 PSI (111,700 MPa), a specific strength of 981, 707 PSI/lb/in$^3$ (245 MPa/g/cm$^3$), and a specific flexibility of 0.0099. In other embodiments, the heat treatment parameters can vary to achieve the desired specific strength and specific flexibility parameters. For example the titanium alloy comprising Ti 6-6-2 can be subject to a heat treatment including heating the titanium alloy to 800-1000 degrees Celsius for 15-75 minutes, followed by a water quench, and subsequently heating the titanium alloy to 400-600 degrees Celsius for 5-7 hours. Further, in other embodiments, the heat treatment parameters can vary with different titanium alloy compositions to achieve the desired specific strength and specific flexibility parameters.

For further example, the stronger, more flexible, and/or lighter titanium alloy can comprise ST721 having 7-8 wt % aluminum, 2-3 wt % molybdenum, 0.5-1.5 wt % iron, and 0.5-1.5 wt % vanadium, with the remaining alloy composition being titanium and other trace elements. In some embodiments, trace elements of the titanium alloy comprising ST721 can include less than 0.25 wt % silicon, less than 0.20 wt % oxygen, less than 0.05 wt % carbon, and less than 0.04 wt % nitrogen. In this example, the density of the ST721 titanium alloy is 0.162 lb/in$^3$ (4.47 g/cm$^3$). Further, in this example, the ST721 titanium alloy has a yield strength of 175,000 PSI (1207 MPa), an elastic modulus of 13,900, 000 PSI (95,840 MPa), a specific strength of 1,083,519 PSI/lb/in$^3$ (270 MPa/g/cm$^3$), and a specific flexibility of 0.0126.

II). Iron-Type Club Head with Stronger, More Flexible, Lighter Material

In many embodiments, the club head comprising the stronger, more flexible, and/or lighter material can be an iron-type club head or a wedge-type club head. In many embodiments, the club head can have a loft greater than or equal to 15 degrees, greater than or equal to 20 degrees, greater than or equal to 25 degrees, greater than or equal to 30 degrees, greater than or equal to 45 degrees, greater than or equal to 50 degrees, or greater than or equal to 55 degrees.

In some embodiments, the entire club head can comprise the stronger, more flexible, and/or lighter material. In other embodiments, at least a portion of the club head can comprise the material, with the remainder of the club head comprising a different material or plurality of materials. For example, in some embodiments, a portion of the club head including the front end 22 and the hosel 18 can comprise the material, and the rear end 24 of the club head can comprise a different material or plurality of materials.

FIG. 2 illustrates the ranges of specific strength (i.e. strength-to-weight ratio) and specific flexibility (i.e. strength-to-modulus ratio) of various steel alloy-type materials used in current club head bodies compared to the stronger, more flexible, and/or lighter materials comprising steel alloys described herein. Known steel alloy-type materials used in current iron-type golf club heads bodies have a specific strength less than 500,000 PSI/lb/in$^3$ (125 MPa/g/cm$^3$), a specific flexibility less than 0.0060, a yield strength less than 170,000 PSI (1172 MPa), and an elastic modulus greater than 35,000,000 PSI (241,317 MPa).

In embodiments where the body of the club head 100 includes the stronger, more flexible, and/or lighter material comprising a steel alloy, and the club head 100 is an iron or wedge type club head, the specific strength of the steel alloy can be greater than or equal to 500,000 PSI/lb/in$^3$ (125 MPa/g/cm$^3$).

For example, the specific strength of the steel alloy can be greater than or equal to 510,000 PSI/lb/in$^3$ (127 MPa/g/cm$^3$), greater than or equal to 520,000 PSI/lb/in$^3$ (130 MPa/g/cm$^3$), greater than or equal to 530,000 PSI/lb/in$^3$ (132 MPa/g/cm$^3$), greater than or equal to 540,000 PSI/lb/in$^3$ (135 MPa/g/cm$^3$), greater than or equal to 550,000 PSI/lb/in$^3$ (137 MPa/g/cm$^3$), greater than or equal to 560,000 PSI/lb/in$^3$ (139 MPa/g/cm$^3$), greater than or equal to 570,000 PSI/lb/in$^3$ (142 MPa/g/cm$^3$), greater than or equal to 580,000 PSI/lb/in$^3$ (144 MPa/g/cm$^3$), greater than or equal to 590,000 PSI/lb/in$^3$ (147 MPa/g/cm$^3$), greater than or equal to 600,000 PSI/lb/in$^3$ (149 MPa/g/cm$^3$), greater than or equal to 625,000 PSI/lb/in$^3$ (156 MPa/g/cm$^3$), greater than or equal to 675,000 PSI/lb/in$^3$ (168 MPa/g/cm$^3$), greater than or equal to 725,000 PSI/lb/in$^3$ (181 MPa/g/cm$^3$), greater than or equal to 775,000 PSI/lb/in$^3$ (193 MPa/g/cm$^3$), greater than or equal to 825,000 PSI/lb/in$^3$ (205 MPa/g/cm$^3$), greater than or equal to 875,000 PSI/lb/in$^3$ (218 MPa/g/cm$^3$), greater than or equal to 925,000 PSI/lb/in$^3$ (230 MPa/g/cm$^3$), or greater than or equal to 975,000 PSI/lb/in$^3$ (243 MPa/g/cm$^3$).

For further example, the specific strength of the steel alloy can be between 510,000 PSI/lb/in$^3$ (127 MPa/g/cm$^3$) and 975,000 PSI/lb/in$^3$ (243 MPa/g/cm$^3$), between 530,000 PSI/lb/in$^3$ (132 MPa/g/cm$^3$) and 975,000 PSI/lb/in$^3$ (243 MPa/g/cm$^3$), between 550,000 PSI/lb/in$^3$ (137 MPa/g/cm$^3$) and 975,000 PSI/lb/in$^3$ (243 MPa/g/cm$^3$), between 570,000 PSI/lb/in$^3$ (142 MPa/g/cm$^3$) and 975,000 PSI/lb/in$^3$ (243 MPa/g/cm$^3$), between 590,000 PSI/lb/in$^3$ (147 MPa/g/cm$^3$) and 975,000 PSI/lb/in$^3$ (243 MPa/g/cm$^3$), between 625,000 PSI/lb/in$^3$ (156 MPa/g/cm$^3$) and 975,000 PSI/lb/in$^3$ (243 MPa/g/cm$^3$), between 675,000 PSI/lb/in$^3$ (168 MPa/g/cm$^3$) and 975,000 PSI/lb/in$^3$ (243 MPa/g/cm$^3$), between 725,000 PSI/lb/in$^3$ (181 MPa/g/cm$^3$) and 975,000 PSI/lb/in$^3$ (243 MPa/g/cm$^3$), between 775,000 PSI/lb/in$^3$ (193 MPa/g/cm$^3$) and 975,000 PSI/lb/in$^3$ (243 MPa/g/cm$^3$), or between 825,000 PSI/lb/in$^3$ (205 MPa/g/cm$^3$) and 975,000 PSI/lb/in$^3$ (243 MPa/g/cm$^3$).

In embodiments where the body of the club head 100 includes the stronger, more flexible, and/or lighter material comprising a steel alloy, and the club head 100 is an iron or wedge type club head, the specific flexibility of the steel alloy can be greater than or equal to 0.0060. For example, the specific flexibility of the steel alloy can be greater than or equal to 0.0062, greater than or equal to 0.0064, greater than or equal to 0.0066, greater than or equal to 0.0068, greater than or equal to 0.0070, greater than or equal to 0.0072, greater than or equal to 0.0076, greater than or equal to 0.0080, greater than or equal to 0.0084, greater than or equal to 0.0088, greater than or equal to 0.0092, greater than or equal to 0.0096, greater than or equal to 0.0100, greater than or equal to 0.0104, greater than or equal to 0.0108, greater than or equal to 0.0112, greater than or equal to 0.0116, greater than or equal to 0.0120, greater than or equal to 0.0125, greater than or equal to 0.0130, greater than or equal to 0.0135, or greater than or equal to 0.0140.

For further example, the specific flexibility of the steel alloy can be between 0.0060 and 0.0140, between 0.0062 and 0.0120, between 0.0064 and 0.0120, between 0.0066 and 0.0120, between 0.0068 and 0.0120, between 0.0070 and 0.0120, between 0.0080 and 0.0120, between 0.0088 and 0.0120, or between 0.0096 and 0.0120.

In some embodiments, the elongation of the stronger, more flexible, and/or lighter steel alloy can be greater than 8%, greater than 9%, greater than 10%, greater than 11%, greater than 12%, greater than 13%, greater than 14%, or greater than 15% to allow plastic deformation of the body to achieve bending for a desired loft and/or lie angle of the club head 100.

In embodiments where the body of the club head 100 includes the stronger, more flexible, and/or lighter material comprising a steel alloy, the yield strength of the steel alloy can be greater than or equal to 170,000 PSI (1172 MPa), greater than or equal to 175,000 PSI (1207 MPa), greater than or equal to 180,000 PSI (1241 MPa), greater than or equal to 185,000 PSI (1276 MPa), greater than or equal to 190,000 PSI (1310 MPa), greater than or equal to 195,000 PSI (1344 MPa), greater than or equal to 200,000 PSI (1379 MPa), greater than or equal to 225,000 PSI (1551 MPa), or greater than or equal to 250,000 PSI (1724 MPa). Further, the yield strength of the steel alloy can be between 170,000 PSI (1172 MPa) and 250,000 PSI (1724 MPa), between 175,000 PSI (1207 MPa) and 250,000 PSI (1724 MPa), between 180,000 PSI (1241 MPa) and 250,000 PSI (1724 MPa), between 190,000 PSI (1310 MPa) and 250,000 PSI (1724 MPa), or between 200,000 PSI (1379 MPa) and 250,000 PSI (1724 MPa).

In embodiments where the body of the club head 100 includes the stronger, more flexible, and/or lighter material comprising a steel alloy, the elastic modulus of the steel alloy can be less than or equal to 35,000,000 PSI (241,317 MPa), less than or equal to 32,500,000 PSI (224,080 MPa), less than or equal to 30,000,000 PSI (206,843 MPa), less than or equal to 28,000,000 PSI (193,053 MPa), less than or equal to 27,500,000 PSI (189,606 MPa), less than or equal to 27,000,000 PSI (186,159 MPa), less than or equal to 26,500,000 PSI (182,711 MPa), less than or equal to 26,000,000 PSI (179,264 MPa), less than or equal to 25,500,000 PSI (175,816 MPa), or less than or equal to 25,000,000 PSI (172,369 MPa). Further, the elastic modulus of the steel alloy can be between 25,000,000 PSI (172,369 MPa) and 35,000,000 PSI (241,317 MPa), between 25,000,000 PSI (172,369 MPa) and 30,000,000 PSI (206,843 MPa), or between 25,000,000 PSI (172,369 MPa) and 27,000,000 PSI (186,159 MPa).

In embodiments where the body of the club head 100 includes the stronger, more flexible, and/or lighter material comprising a steel alloy, the density of the steel alloy can be less than or equal to 0.40 lb/in$^3$ (11.0 g/cm$^3$), less than or equal to 0.35 lb/in$^3$ (9.7 g/cm$^3$), less than or equal to 0.30 lb/in$^3$ (8.3 g/cm$^3$), less than or equal to 0.29 lb/in$^3$ (8.0 g/cm$^3$), less than or equal to 0.28 lb/in$^3$ (7.8 g/cm$^3$), less than or equal to 0.27 lb/in$^3$ (7.5 g/cm$^3$), less than or equal to 0.26 lb/in$^3$ (7.2 g/cm$^3$), or less than or equal to 0.25 lb/in$^3$ (6.9 g/cm$^3$). Further, the density of the steel alloy can be between 0.25 lb/in$^3$ (6.9 g/cm$^3$) and 0.40 lb/in$^3$ (11.0 g/cm$^3$), between 0.25 lb/in$^3$ (6.9 g/cm$^3$) and 0.35 lb/in$^3$ (9.7 g/cm$^3$), between 0.25 lb/in$^3$ (6.9 g/cm$^3$) and 0.30 lb/in$^3$ (8.3 g/cm$^3$), or between 0.25 lb/in$^3$ (6.9 g/cm$^3$) and 0.28 lb/in$^3$ (7.8 g/cm$^3$).

Referring to FIG. 2, the specific strength and/or the specific flexibility of the stronger, more flexible, and/or lighter steel alloys are shifted to a region of the graph outside of the current steel alloy-type materials used in golf club head bodies. For example, the specific strength of the steel alloy can be greater than the specific strength of known steel alloy-type materials used in current golf club head bodies (e.g. material B compared to material A in FIG. 5). Increased specific strength can result in reduced club head weight or increased discretionary weight compared to a similar club head with known steel alloys. For further example, the specific flexibility of the steel alloy can be greater than the specific flexibility of known steel alloy-type materials used in current golf club head bodies (e.g. material C compared to material A in FIG. 5). Increased specific flexibility can result in increased flexibility of the club head body, thereby increasing energy transfer to a golf ball on impact, compared to a similar club head with known steel alloys. In many embodiments, the specific strength and the specific flexibility of the steel alloy can be greater than the specific strength and specific flexibility, respectively, of known steel alloy-type materials (e.g. material D compared to material A in FIG. 5).

In embodiments where the body of the club head 100 comprises the stronger, more flexible, and/or lighter steel alloy, the steel alloy can have any composition capable of achieving the desired specific strength and specific flexibility. Further, in many embodiments, the steel alloy can be subject to a heat treatment process to achieve the specific strength and the specific flexibility described above. In many embodiments, the heat treatment process includes heating the steel alloy to approximately 850 degrees Celsius for at least 30 minutes, quenching the steel alloy, and performing at least one tempering step (i.e. a first tempering step). In many embodiments, the at least one tempering step includes heating the steel alloy to a temperature less than approximately 600-700 degrees Celsius for at least 30 minutes, and allowing the steel alloy to cool in air or at room temperature. In some embodiments, the heat treatment process can include additional tempering steps including heating the steel alloy to a temperature less than approximately 600-700 degrees Celsius for at least 30 minutes, and allowing the steel alloy to cool in air or at room temperature, wherein the temperature of the additional tempering step can be the same as, less than, or greater than the first tempering step.

In many embodiments, the at least one tempering step relieves internal stresses in the stronger, more flexible, and/or lighter steel alloy to achieve the desired specific strength and specific flexibility. In some embodiments, the one or more tempering steps can include heating the steel alloy to a temperature between approximately 200-650 degrees Celsius for at least 30 minutes to relieve the internal stresses in the steel alloy, while maintaining a desired elongation, such as, for example, and elongation greater than 8-10%. In some embodiments, maintaining the elongation of the steel alloy to greater than 8%, greater than 9%, or greater than 10% allows the club head body comprising the steel alloy to be bent for a desired loft and/or lie angle.

For example, the stronger, more flexible, and/or lighter material can comprise a 4140 alloy steel having 0.30-0.43 wt % carbon, 0.80-1.1 wt % chromium, 0.5-1.0 wt % manganese, 0.15-0.25 wt % molybdenum, and 0.15-0.30 wt % silicon, with the remaining alloy composition being iron and other trace elements. In some embodiments, trace elements of the material comprising 4140 alloy steel can include less than 0.035 wt % phosphorous, and less than 0.04 wt % sulfur. In this example, the density of the 4140 steel alloy is 0.284 lb/in$^3$ (7.85 g/cm$^3$).

In this example, the steel alloy comprising 4140 alloy steel can be subject to an exemplary heat treatment process comprising: heating the steel alloy to a temperature of approximately 850 degrees Celsius for approximately 1 hour, quenching the steel alloy in oil, tempering the steel alloy at approximately 400 degrees Celsius for approximately 4 hours, cooling the steel alloy in air, tempering the steel alloy at approximately 300 degrees Celsius for approximately 4 hours, and cooling the steel alloy in air. In this example, the heat treatment process results in the 4140 steel alloy having a yield strength of 187,800 PSI (1295 MPa), an elastic modulus of 29,560,000 PSI (203,810 MPa), a specific strength of 662,202 PSI/lb/in$^3$ (165 MPa), a specific flexibility of 0.0064, an elongation of 14%. In other embodiments, the heat treatment parameters can vary to achieve the desired specific strength and specific flexibility parameters. For example, the steel alloy comprising 4140 alloy steel can be subject to heat treatment process comprising: heating the steel alloy to a temperature of 800-900 degrees Celsius for 30-90 minutes, quenching the steel alloy in oil, tempering the steel alloy at approximately 350-450 degrees Celsius for 3-4 hours, cooling the steel alloy in air, tempering the steel alloy at 250-350 degrees Celsius for 5-7 hours, and cooling the steel alloy in air.

For further example, the stronger, more flexible, and/or lighter steel alloy can comprise a 4340 alloy steel having 1.65-2.00 wt % nickel, 0.30-0.43 wt % carbon, 0.7-0.9 wt % chromium, 0.6-0.8 wt % manganese, 0.2-0.3 wt % molybdenum, and 0.15-0.30 wt % silicon, with the remaining alloy composition being iron and other trace elements. In some embodiments, trace elements of the material comprising 4340 alloy steel can include less than 0.035 wt % phosphorous, and less than 0.04 wt % sulfur.

For further example, the stronger, more flexible, and/or lighter steel alloy can comprise C300 steel having 18.0-19.0 wt % nickel, 8.5-9.5 wt % cobalt, 4.6-5.2 wt % molybdenum, with the remaining alloy composition being iron and other trace elements. In some embodiments, trace elements of the steel alloy comprising C300 steel can include 0.5-0.8 wt % titanium, 0.05-0.15 wt % aluminum, less than 0.5 wt % chromium, less than 0.5 wt % copper, less than 0.1 wt % manganese, less than 0.1 wt % silicon, less than 0.3 wt % carbon, less than 0.01 wt % phosphorus, or less than 0.01 wt % sulfur.

For further example, the stronger, more flexible, and/or lighter steel alloy can comprise a quench and tempered steel alloy having 3.0-4.5 wt % nickel, 1.0-2.0 wt % silicon, 0.75-1.5 wt % chromium, less than 1.0 wt % copper, less than 1.25 wt % manganese, less than 1.0 wt % molybdenum, less than 0.75 wt % vanadium, with the remaining alloy composition being iron and other trace elements. In this example, the density of the quench and tempered steel alloy is 0.284 lb/in$^3$ (7.86 g/cm$^3$).

In this example, the quench and tempered steel alloy can be subject to an exemplary heat treatment process to achieve the specific strength and the specific flexibility described above. The exemplary heat treatment process can include heating the steel alloy at approximately 918 degrees Celsius for approximately 60 minutes, followed by nitrogen cooling and a cryogenic freezing at −73 degrees Celsius for approximately 8 hours, followed by heating the steel alloy at approximately 260 degrees Celsius for approximately 2 hours. In this example, the quench and tempered steel alloy scan have a yield strength of 220,000 PSI (1517 MPa), an elastic modulus of 23,100,000 PSI (159,270 MPa), a specific strength of 774,755 PSI/lb/in$^3$ (193 MPa/g/cm$^3$), and a specific flexibility of 0.0095. In other embodiments, the heat treatment parameters can vary to achieve the desired specific strength and specific flexibility parameters.

For example, the heat treatment process can include heating the steel alloy at approximately 850-1000 degrees Celsius for approximately 30-90 minutes, followed by nitrogen cooling and an optional cryogenic freezing for approximately 6-10 hours, followed by heating the steel alloy at approximately 200-350 degrees Celsius for approximately 1-3 hours. Further, in other embodiments, the heat treatment parameters can vary with different steel alloy compositions to achieve the desired specific strength and specific flexibility parameters.

B. Advantages of Stronger, More Flexible, Lighter Material

The stronger, more flexible, and/or lighter material of the club head 100 can improve desired performance characteristics of the club head 100, independent of club head design, while maintaining strength for durability. Performance characteristics of the club head 100 having the material or plurality of materials can be improved over similar club heads with known materials by selecting or developing the material to have an increased specific strength and an increased specific flexibility, as discussed above. Accordingly, the performance characteristics of the club head 100 having the material or plurality of materials can be improved over a similar club head with known materials having performance characteristics achieved based on design alone.

The club head 100 having the material with the specific strength greater than the specific strength of current club head materials for a similar material class can have reduced weight or increased discretionary weight compared to a similar club head with known materials. Increased discretionary weight allows for increased design flexibility in achieving a desired center of gravity position and increasing the moment of inertia of the club head 100 to increase forgiveness for off center hits.

The club head 100 having the material with the specific flexibility greater than the specific flexibility of current club head materials for a similar material class has increased flexibility compared to a similar club head with known materials. Increased flexibility can reduce energy loss on impact with a golf ball, thereby increasing energy transfer to the ball resulting in increased ball speed and travel distance.

As discussed above, FIG. 5 illustrates various exemplary stronger, more flexible, and/or lighter materials (i.e. materials B, C, and D) compared to an exemplary known club head material A. Referring to FIG. 5, an exemplary material B has a higher specific strength and a similar specific flexibility compared to an exemplary known material A used in current golf club heads. In many embodiments, material B can have a lower density, and therefore a higher specific strength, than material A. Accordingly, in these embodiments, a club head comprising material B can be designed to have reduced weight (and therefore increased discretionary weight) compared to a club head comprising known material A. Further, in many embodiments, material B can have a higher yield strength, and therefore a higher specific strength, than known material A. Accordingly, in these embodiments, a club head comprising material B can have reduced thickness, while maintaining durability, compared to a club head comprising known material A. In some embodiments, reduced thickness can result in additional weight savings and further increased discretionary weight.

Therefore, a club head comprising material B will be lighter in weight compared to a club head comprising current club head material A. Further, a club head comprising material B has similar ball speed compared to a club head comprising known material A, as a higher modulus will offset any increase in flexibility due to thinning of the club head as a result of increased yield strength.

Further referring to FIG. 5, an exemplary stronger, more flexible, and/or lighter material C has a higher specific flexibility and a similar specific strength than exemplary known material A used in current golf club heads. In many embodiments, material C can have a lower elastic modulus, and therefore a higher specific flexibility, than known material A. Accordingly, in these embodiments, a club head comprising material C can have increased flexibility (and therefore increased ball speed on impact with a golf ball) compared to a club head comprising known material A with a similar design. Further, in many embodiments, material C can have a higher yield strength, and therefore a higher specific flexibility, than known material A. Accordingly, in these embodiments, a club head comprising material C can have reduced thickness, while maintaining durability, compared to a club head comprising known material A. In some embodiments, reduced thickness can result in additional weight savings and further increased discretionary weight. Therefore, a club head comprising material C will have increased ball speed on impact with a golf ball and will have a similar weight compared to a club head comprising known material A, as a higher density will offset any weight savings due to thinning of the club head as a result of increased yield strength.

Further still, referring to FIG. 5, an exemplary stronger, more flexible, and/or lighter material D has a higher specific strength and a higher specific flexibility than exemplary known material A used in current golf club heads. In many embodiments, material D can have a lower density, and therefore a higher specific strength, than known material A. Accordingly, in these embodiments, a club head comprising material D can be designed to have reduced weight (and therefore increased discretionary weight) compared to a club head comprising known material A. Further, in many embodiments, material D can have a lower elastic modulus, and therefore a higher specific flexibility, than known material A. Accordingly, in these embodiments, a club head comprising material D can have increased flexibility (and therefore increased ball speed on impact with a golf ball) compared to a club head comprising known material A with a similar design. Further still, in many embodiments, material D can have a higher yield strength, and therefore a higher specific strength and/or specific flexibility, than known material A. Accordingly, in these embodiments, a club head comprising material D can have reduced thickness, while maintaining durability, compared to a club head comprising known material A. In some embodiments, reduced thickness can result in additional weight savings and further increased discretionary weight. Therefore, a club head comprising material D will be lighter in weight and will have more ball speed on impact with a golf ball than a club head comprising known material A.

Accordingly, a club head comprising a material having an increased specific strength, combined with an increased specific flexibility, can be most advantageous for club head performance (by increasing ball speed and increasing discretionary weight). In contrast, a club head comprising a material having one of: an increased specific strength or an increased specific flexibility can provide performance advantages, but may not provide as many advantages as a club head comprising a material having both increased specific strength and increased specific flexibility.

The stronger, more flexible, and/or lighter material can be achieved using specific material compositions, specific processing techniques (e.g. heat treating parameters), specific manufacturing methods (e.g. casting, machining), or a combination of the above described optimization techniques.

C. Method of Manufacturing Club Head Having Stronger, More Flexible, Lighter Material A method of manufacturing the golf club head 100 includes forming a club head 100 having a faceplate 14 and a body 10, at least one of the faceplate 14 and the body 10 having a stronger, more flexible, and/or lighter material (hereafter "material") or plurality of materials having a specific strength and a specific flexibility.

In some embodiments, the faceplate 14 is formed separately from the body 10 and is coupled to the body 10 to form the club head 100. In other embodiments, the faceplate 14 is formed integrally with the body 10 or a portion of the body 10 to form the club head 100. For example, in some embodiments, the faceplate 14 and the body 10 can be formed together. For further example, in some embodiments, the faceplate 14 can be formed with a portion of the body 10 including at least one of the front end 22, the top 30, the bottom 34, the heel portion 26, the toe portion 28, and the hosel 18, while the rear end 22 or remainder of the club head 100 is formed separately. For example, the faceplate 14 and a portion of the body 10 (e.g. the faceplate 14 and the front end 22 of the body 10 including the hosel 18) can be forged as a single piece, the remainder of the body 10 (e.g. the rear end 22) can be cast as a separate piece and subsequently coupled to the faceplate 14 by welding or any other suitable method.

In embodiments where the faceplate 14 includes the material, the faceplate 14 can be formed at least in part by machining, casting, 3D printing, metal injection molding, forging, or any other suitable method. In some embodiments, the material composition can allow machining of the club head faceplate similar to many current materials used in golf club head faceplates. For example, the material composition can allow for machining of the faceplate for various types of club heads, such as driver-type club heads, fairway wood-type club heads, hybrid-type club heads, iron-type club heads, wedge-type club heads, or putter-type club heads. In some embodiments, the material composition can allow casting of the club head faceplate similar to many current materials used in golf club head faceplates. For example, the material composition can allow for casting of the faceplate for various types of club heads, such as driver-type club heads, fairway wood-type club heads, hybrid-type club heads, iron-type club heads, wedge-type club heads, or putter-type club heads.

In embodiments where the faceplate 14 includes the material, the faceplate 14 can undergo one or more post processing procedures, such as, for example, heat treating or tempering to achieve the desired properties of the material. In these embodiments, heat treating or tempering at various temperatures for various durations can result in the desired specific strength and/or the desired specific flexibility of the material. In embodiments where the faceplate 14 undergoes post processing, the post processing can be performed before or after the faceplate 14 is coupled to the body 10 to form the club head 100.

In embodiments where the body 10 includes the material, the body 10 can be formed at least in part by machining, casting, 3D printing, metal injection molding, forging, or any other suitable method. In some embodiments, the material composition can allow casting of the club head body similar to many current materials used in golf club head bodies. For example, the material composition can allow for casting of the body for various types of club heads, such as driver-type club heads, fairway wood-type club heads, hybrid-type club heads, iron-type club heads, wedge-type club heads, or putter-type club heads. In some embodiments, the material composition can allow machining of the club head body similar to many current materials used in golf club head bodies. For example, the material composition can allow for machining of the body for various types of club heads, such as iron-type club heads, wedge-type club heads, or putter-type club heads.

In embodiments where the body 10 includes the material, the body 10 can undergo one or more post processing procedures, such as, for example, heat treating or tempering to achieve the desired properties of the material. In these embodiments, heat treating or tempering at various temperatures for various durations can result in the desired specific strength and/or the desired specific flexibility of the material. In embodiments where the body 10 undergoes post processing, the post processing can be performed before or after the body 10 is coupled to the faceplate 14 to form the club head 100.

The method of manufacturing described herein is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

D. Examples

Figure 6A:
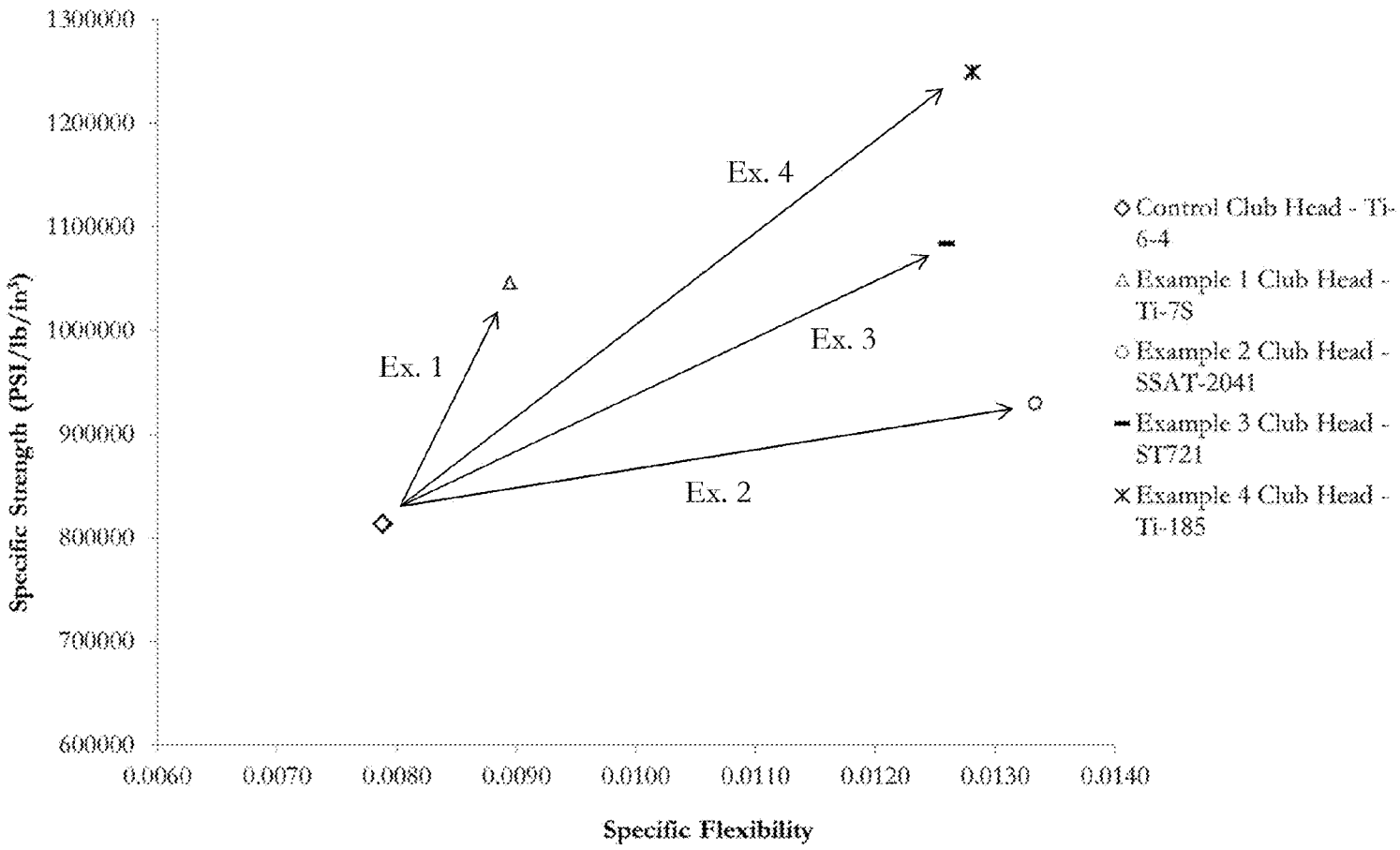
FIG. 6A illustrates the relationship between strength-to-weight ratios and strength-to-modulus ratios of various exemplary materials.
Figure 6B:
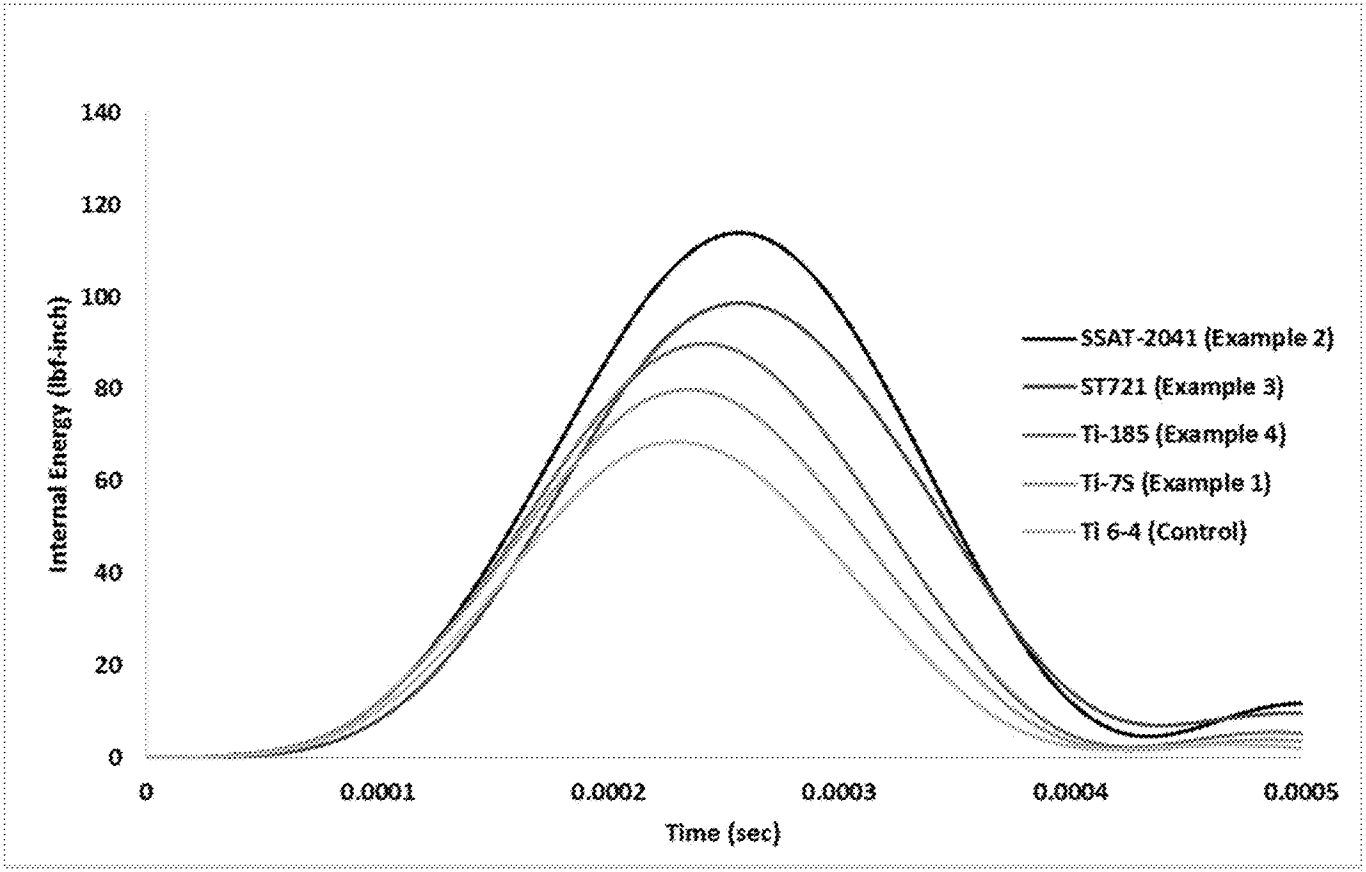
FIGS. 6B-6C illustrate the internal energy of the exemplary materials of FIG. 6A.

Referring to FIG. 6A, various exemplary club heads having faceplates comprising different materials are described below relative to a control golf club head having a faceplate comprising Ti-6-4, a known golf club head material and a body comprising Ti-8-1-1, a known golf club head material. In these examples, the faceplate of the control club head comprising Ti-6-4 has 5.5-6.7 wt % aluminum and 3.5-4.5 wt % vanadium with the remaining alloy composition being titanium and other trace elements including less than or equal to 0.08 wt % carbon, less than or equal to 0.015 wt % hydrogen, less than or equal to 0.25 wt % iron, less than or equal to 0.05 wt % nitrogen, and less than or equal to 0.2 wt % oxygen. In these examples, the faceplate of the control club head comprising Ti-6-4 has a density of 0.160 lb/in$^3$ (4.42 g/cm$^3$), a yield strength of 130,000 PSI (896 MPa), an elastic modulus of 16,500,000 PSI (113,760 MPa), a specific strength of 814,026 PSI/lb/in$^3$ (203 MPa), and a specific flexibility of 0.0079. In these examples, the faceplate of the control golf club head has a maximum thickness of 0.150 inch and a minimum thickness of 0.100 inch to maximize face deflection and prevent failure based on the above described parameters. Referring to FIG. 6B, on impact with a golf ball at 100 miles per hour (mph), the control golf club head stores 68.6 lbf-inch of internal energy. The body material of the exemplary golf club heads described below are the same as the control club head (Ti-8-1-1).

I). Example 1

In one example, an exemplary golf club head can have a faceplate comprising Ti-7S, wherein the Ti-7S includes 7.0-8.0 wt % aluminum, 1.75-2.25 wt % chromium, 2.25-2.75 wt % molybdenum, 0.75-1.25 wt % vanadium, and 0.35-0.65 wt % iron, with the remaining alloy composition being titanium and other trace elements including less than or equal to 0.2 wt % silicon. In this example, the faceplate comprising Ti-7S has a density of 0.162 lb/in$^3$ (4.47 g/cm$^3$), a yield strength of 169,000 PSI (1165 MPa), an elastic modulus of 18,900,000 PSI (130,310 MPa), a specific strength of 1,406,440 PSI/lb/in$^3$ (261 MPa), and a specific flexibility of 0.0089.

The exemplary golf club head has a specific strength greater than the specific strength of the control golf club head. Further, the exemplary golf club head has a specific flexibility greater than but similar to the specific flexibility of the control golf club head. In some embodiments, the faceplate thickness of the exemplary golf club head can be the same as the faceplate thickness of the control golf club head. In these embodiments, referring to FIG. 6B, the exemplary golf club head has 79.9 lb-inch of internal energy on impact with a golf ball at 100 mph, 16.5% greater than the control golf club head. Further, in these embodiments, the faceplate of the exemplary golf club head is 0.5 grams heavier than the control golf club head, as the faceplate density of the exemplary golf club head is greater than the faceplate density of the control golf club head. In these embodiments, the exemplary golf club head has higher ball speed on impact with a golf ball than the control golf club head. Increased ball speed results from increased internal energy storage on impact due to increased bending of the faceplate, which results from increased specific flexibility (reduced elastic modulus).

In other embodiments according to this example, the exemplary golf club head can have a reduced faceplate thickness, and maintained durability, compared to the control golf club head, as the yield strength of the exemplary golf club head is greater than the yield strength of the control golf club head. In this example, the faceplate of the exemplary golf club head is reduced compared to the control club head such that the faceplate has a maximum thickness of 0.140 inch and a minimum thickness of 0.090 inch. In these embodiments, the exemplary golf club head has higher ball speed on impact with a golf ball than the control golf club head. Increased ball speed results from increased internal energy storage on impact due to increased bending of the faceplate, which results from increased specific flexibility and reduced faceplate thickness. In these embodiments, the ball speed of the exemplary golf club head having reduced faceplate thickness is also greater than the ball speed of the exemplary club head having the same thickness as the control golf club head. Further, in these embodiments, the faceplate of the exemplary golf club head is 3 grams lighter than the control golf club head, resulting in increased discretionary weight of the exemplary golf club head.

II). Example 2

In one example, an exemplary golf club head can have a faceplate comprising SSAT-2041, wherein the SSAT-2041 includes 21.0-23.0 wt % vanadium, 3.5-4.5 wt % aluminum, and 0.5-1.5 wt % tin, with the remaining alloy composition being titanium and other trace elements, including less than or equal to 0.05 wt % carbon, less than or equal to 1.0 wt % silicon, less than or equal to 1.0 wt % molybdenum, and less than or equal to 0.50 wt % iron. In this example, the faceplate comprising SSAT-2041 has a density of 0.172 lb/in$^3$ (4.76 g/cm$^3$), and is subject to a first heat treatment at 800 degrees Celsius for 30 minutes and a second heat treatment at 480 degrees Celsius at 6.5 hours, resulting in a yield strength of 160,000 PSI (1103 MPa), an elastic modulus of 12,000,000 PSI (82,740 MPa), a specific strength of 930,422 PSI/lb/in$^3$ (232 MPa), and a specific flexibility of 0.0133.

The exemplary golf club head has a specific strength greater than but similar to the specific strength of the control golf club head. Further, the exemplary golf club head has a specific flexibility greater than the specific flexibility of the control golf club head. In some embodiments, the faceplate thickness of the exemplary golf club head can be the same as the faceplate thickness of the control golf club head. In these embodiments, referring to FIG. 6B, the exemplary golf club head has 114.0 lb-inch of internal energy on impact with a golf ball at 100 mph, 66.2% greater than the control golf club head. Further, in these embodiments, the faceplate of the exemplary golf club head is 2.5 grams heavier than the control golf club head, as the faceplate density of the exemplary golf club head is greater than the faceplate density of the control golf club head. In these embodiments, the exemplary golf club head has higher ball speed on impact with a golf ball than the control golf club head. Increased ball speed results from increased internal energy storage on impact due to increased bending of the faceplate, which results from increased specific flexibility (reduced elastic modulus).

In other embodiments according to this example, the exemplary golf club head can have a reduced faceplate thickness, and maintained durability, compared to the control golf club head, as the yield strength of the exemplary golf club head is greater than the yield strength of the control golf club head. In this example, the faceplate of the exemplary golf club head is reduced compared to the control club head such that the faceplate has a maximum thickness of 0.145 inch and a minimum thickness of 0.095 inch. In these embodiments, the exemplary golf club head has higher ball speed on impact with a golf ball than the control golf club head. Increased ball speed results from increased internal energy storage on impact due to increased bending of the faceplate, which results from increased specific flexibility (reduced elastic modulus) and reduced faceplate thickness. In these embodiments, the ball speed of the exemplary golf club head having reduced faceplate thickness is also greater than the ball speed of the exemplary club head having the same thickness as the control golf club head. Further, in these embodiments, the faceplate of the exemplary golf club head is 0.7 grams heavier than the control golf club head, as the faceplate density of the exemplary golf club head is greater than the faceplate density of the control golf club head.

III). Example 3

In one example, an exemplary golf club head can have a faceplate comprising ST721, wherein the ST721 includes 7.0-8.0 wt % aluminum, 2.0-3.0 wt % molybdenum, 0.5-1.5 wt % iron, and 0.5-1.5 wt % vanadium, with the remaining alloy composition being titanium and other trace elements, including less than or equal to 0.04 wt % nitrogen, less than or equal to 0.05 wt % carbon, less than or equal to 0.20 wt % oxygen, and less than or equal to 0.25 wt % silicon. In this example, the faceplate comprising ST721 has a density of 0.013 lb/in$^3$ (4.47 g/cm$^3$), a yield strength of 175,000 PSI (1207 MPa), an elastic modulus of 13,900,000 PSI (95,840 MPa), a specific strength of 1,083,591 PSI/lb/in$^3$ (270 MPa), and a specific flexibility of 0.0126.

The exemplary golf club head has a specific strength greater than the specific strength of the control golf club head. Further, the exemplary golf club head has a specific flexibility greater than the specific flexibility of the control golf club head. In some embodiments, the faceplate thickness of the exemplary golf club head can be the same as the faceplate thickness of the control golf club head. In these embodiments, referring to FIG. 6B, the exemplary golf club head has 98.7 lb-inch of internal energy on impact with a golf ball at 100 mph, 43.9% greater than the control golf club head. Further, in these embodiments, the faceplate of the exemplary golf club head is 0.5 grams heavier than the control golf club head, as the faceplate density of the exemplary golf club head is greater than the faceplate density of the control golf club head. In these embodiments, the exemplary golf club head has higher ball speed on impact with a golf ball than the control golf club head. Increased ball speed results from increased internal energy storage on impact due to increased bending of the faceplate, which results from increased specific flexibility (reduced elastic modulus).

In other embodiments according to this example, the exemplary golf club head can have a reduced faceplate thickness, and maintained durability, compared to the control golf club head, as the yield strength of the exemplary golf club head is greater than the yield strength of the control golf club head. In this example, the faceplate of the exemplary golf club head is reduced compared to the control club head such that the faceplate has a maximum thickness of 0.140 inch and a minimum thickness of 0.090 inch. In these embodiments, the exemplary golf club head has higher ball speed on impact with a golf ball than the control golf club head. Increased ball speed results from increased internal energy storage on impact due to increased bending of the faceplate, which results from increased specific flexibility (reduced elastic modulus) and reduced faceplate thickness. In these embodiments, the ball speed of the exemplary golf club head having reduced faceplate thickness is also greater than the ball speed of the exemplary club head having the same thickness as the control golf club head. Further, in these embodiments, the faceplate of the exemplary golf club head is 3 grams lighter than the control golf club head, resulting in increased discretionary weight of the exemplary club head.

IV). Example 4

In one example, an exemplary golf club head can have a faceplate comprising Ti-185, wherein the Ti-185 includes approximately 7.5-8.5 wt % vanadium, 4.0-6.0 wt % iron, 0.8-1.5 wt % aluminum, 0.25-0.5 wt % oxygen, with the remaining alloy composition being titanium and other trace elements, including less than or equal to 0.07 wt % nitrogen, and less than or equal to 0.05 wt % carbon. In this example, the faceplate comprising Ti-185 has a density of 0.168 lb/in$^3$ (4.65 g/cm$^3$), and is subject to a heat treatment at 675 degrees Celsius for 30 minutes, resulting in a yield strength of 178,000 PSI (1227 MPa), an elastic modulus of 16,500,000 PSI (113,760 MPa), a specific strength of 1,059,524 PSI/lb/in$^3$ (264 MPa), and a specific flexibility of 0.0108.

The exemplary golf club head has a specific strength greater than the specific strength of the control golf club head. Further, the exemplary golf club head has a specific flexibility greater than the specific flexibility of the control golf club head. In some embodiments, the faceplate thickness of the exemplary golf club head can be the same as the faceplate thickness of the control golf club head. In these embodiments, referring to FIG. 6B, the exemplary golf club head has 89.9 lb-inch of internal energy on impact with a golf ball at 100 mph, 31.0% greater than the control golf club head. Further, in these embodiments, the faceplate of the exemplary golf club head is 1.5 grams heavier than the control golf club head, as the faceplate density of the exemplary golf club head is greater than the faceplate density of the control golf club head. In these embodiments, the exemplary golf club head has higher ball speed on impact with a golf ball than the control golf club head.

Increased ball speed results from increased internal energy storage on impact due to increased bending of the faceplate, which results from increased specific flexibility.

Figure 6C:
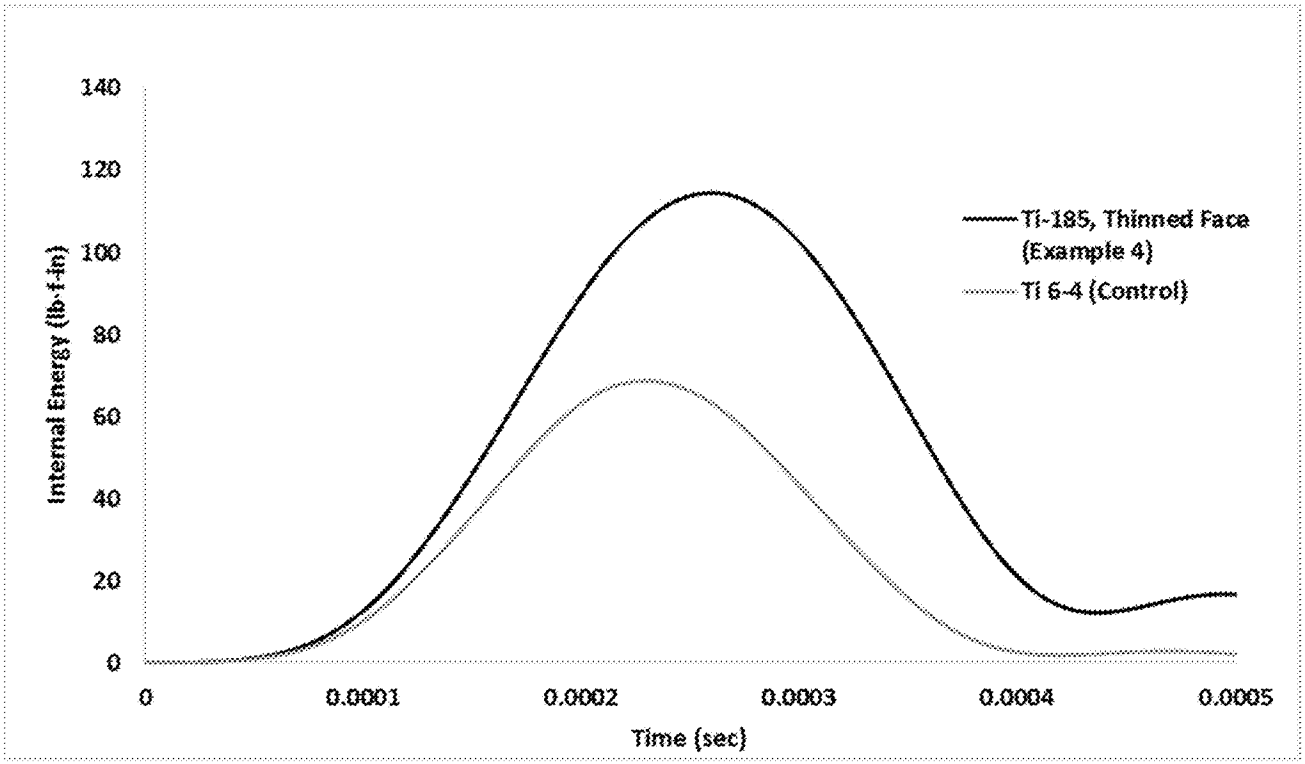

In other embodiments according to this example, the exemplary golf club head can have a reduced faceplate thickness, and maintained durability, compared to the control golf club head, as the yield strength of the exemplary golf club head is greater than the yield strength of the control golf club head. In this example, the faceplate of the exemplary golf club head is reduced compared to the control club head such that the faceplate has a maximum thickness of 0.130 inch and a minimum thickness of 0.080 inch. In these embodiments, the exemplary golf club head has higher ball speed on impact with a golf ball than the control golf club head. Increased ball speed results from increased internal energy storage on impact due to increased bending of the faceplate, which results from increased specific flexibility and reduced faceplate thickness. Referring to FIG. 6C, the exemplary golf club head has 114.4 lb-inch of internal energy on impact with a golf ball at 100 mph, 66.8% greater than the control golf club head. Further, in these embodiments, the faceplate of the exemplary golf club head is 6 grams lighter than the control golf club head, resulting in increased discretionary weight of the exemplary golf club head.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising:
a body; and
a faceplate comprising a material having:
a density;
a yield strength;
an elastic modulus;
a specific strength measured as a ratio of the yield strength to the density; and
a specific flexibility measured as a ratio of the yield strength to the elastic modulus; wherein
the material is
a titanium alloy, wherein the specific strength of the titanium alloy is greater than 1,065,000 PSI/(lb/in$^3$), the specific flexibility of the titanium alloy is greater than 0.0090, and the titanium alloy comprises 7.5-8.5 wt % vanadium, 0.8-1.5 wt % aluminum, and 4.0-6.0 wt % iron, with the remaining alloy composition being titanium and other trace elements;
wherein the titanium alloy has been subjected to a first heat treatment at 700-800 degrees Celsius for 30-90 minutes and a second heat treatment at 400-550 degrees Celsius for 1-3 hours;
wherein the club head is a driver, a hybrid, or a fairway wood type club head; wherein the faceplate has a thickness between 0.080 inch and 0.130 inch; wherein the club head has an internal energy greater than 80 lbf-in upon impact with a golf ball at 100 mph.

2. The golf club head of claim 1, wherein when the material is a titanium alloy, the specific strength is greater than 1,075,000 PSI/(lb/in$^3$).

3. The golf club head of claim 1, wherein when the material is a titanium alloy, the specific strength is greater than 1,110,000 PSI/(lb/in$^3$).

4. The golf club head of claim 1, wherein when the material is a titanium alloy, the specific flexibility is greater than 0.0110.

5. The golf club head of claim 1, wherein when the material is a titanium alloy, the yield strength of the material is greater than 160,000 PSI.

6. The golf club head of claim 1, wherein when the material is a titanium alloy, the elastic modulus of the material is less than 16,500,000 PSI.

7. A golf club head comprising:
a body; and
a faceplate comprising a material having:
a density;
a yield strength;
an elastic modulus;
a specific strength measured as a ratio of the yield strength to the density; and
a specific flexibility measured as a ratio of the yield strength to the elastic modulus; wherein
the material is
a titanium alloy, wherein the specific flexibility of the titanium alloy is greater than or equal to 0.0130, and the titanium alloy comprises 7.5-8.5 wt % vanadium, 0.8-1.5 wt % aluminum, and 4.0-6.0 wt % iron, with the remaining alloy composition being titanium and other trace elements;
wherein the titanium alloy has been subjected to a first heat treatment at 700-800 degrees Celsius for 30-90 minutes and a second heat treatment at 400-550 degrees Celsius for 1-3 hours; wherein the faceplate has a thickness between 0.080 inch and 0.130 inch; wherein the club head has an internal energy greater than 80 lbf-in upon impact with a golf ball at 100 mph.

* * * * *